US006120079A

United States Patent [19]

Schiller

[11] Patent Number: 6,120,079

[45] **Date of Patent: *Sep. 19, 2000**

[54] GARBAGE COLLECTION AND TRANSPORT SYSTEM

[75] Inventor: Rolf Schiller, Ravensburg, Germany

[73] Assignee: MultiRec Patentverwertungs-und Vertriebsgesellschaft mbH, Ravensburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,576

[22] PCT Filed: May 19, 1995

[86] PCT No.: PCT/DE95/00661

§ 371 Date: Nov. 15, 1996

§ 102(e) Date: Nov. 15, 1996

[87] PCT Pub. No.: WO95/32135

PCT Pub. Date: Nov. 30, 1995

[30] Foreign Application Priority Data

May 19, 1994 [DE] Germany ..... 44 17 525

[51] Int. Cl.[7] ..... B65F 3/14

[52] U.S. Cl. ..... 296/56; 296/57.1; 298/8 R; 298/23 MD; 414/519

[58] Field of Search ..... 105/375; 296/56, 296/57.1, 58, 59, 60; 298/8 H, 8 R, 23 MD, 23 S; 414/408, 512, 520

[56] References Cited

U.S. PATENT DOCUMENTS

| | | | |
|---|---|---|---|
| 2,212,058 | 8/1940 | Wood | 298/23 MD |
| 2,837,230 | 6/1958 | Herterich . | |
| 4,441,754 | 4/1984 | Hantel | 296/56 X |
| 4,666,211 | 5/1987 | Smith et al. | 298/8 R |
| 5,527,098 | 6/1996 | McKinney et al. | 296/56 X |

FOREIGN PATENT DOCUMENTS

| | | |
|---|---|---|
| 0220483 | 5/1987 | European Pat. Off. . |
| 0257442 | 3/1988 | European Pat. Off. . |
| 0314238 | 5/1989 | European Pat. Off. . |
| 0535072 | 4/1993 | European Pat. Off. . |
| 1 023 395 | 1/1958 | Germany . |
| 2558433 | 6/1977 | Germany . |
| 3537546 | 4/1987 | Germany . |
| 36 29 291 A1 | 3/1988 | Germany . |
| 41 21 442 A1 | 1/1992 | Germany . |
| 92/00232 | 1/1992 | WIPO . |

OTHER PUBLICATIONS

VDI Nachrichten [VDI Notices] No. 45, No. 12, 1976, p. 16.

*Primary Examiner*—Janice L. Krizek
*Attorney, Agent, or Firm*—Venable; Robert Kinberg; Catherine Voorhees

[57] ABSTRACT

A garbage collection and transport system, in which a garbage vehicle (1) has a horizontal partition (4) for forming two stowage spaces (5, 6) located one above the other, is proposed. So that different types of garbage containers (9) can be emptied, the garbage vehicle (1) has a loading trough (22) which extends the partition (4) and which can be positioned with its end edge (29) in such a way that it is adapted to that chamber (14, 15) of the garbage container (9) which is in each case to be separated off.

30 Claims, 16 Drawing Sheets

GARBAGE COLLECTION AND TRANSPORT SYSTEM

BACKGROUND OF THE INVENTION

The invention relates to a garbage collection and transport system for use with a single-chamber or multichamber garbage container for the reception of waste materials.

DE-A-25 58 433 or also EP-A-0,220,483 discloses a garbage collection and transport system, in which both the collecting container or garbage container and the garbage vehicle itself are divided by means of at least one partition into a plurality of chambers which receive different garbage fractions. In this case, the garbage container, when being emptied by means of a charging or dumping device on the garbage vehicle, is emptied in such a way that the respective chambers in the garbage container and in the garbage vehicle remain assigned to one another, that is to say individual garbage fractions also remain separate from one another in the garbage vehicle. This system became known as a so-called multichamber garbage system in numerous literature publications (for example, VDI Nachrichten [VDI Notices] No. 45 of 12.11.1976, page 16).

The stowage spaces in the garbage vehicle are separated either by vertical longitudinal partitions with stowage spaces arranged next to one another or, for example, by means of a horizontal longitudinal partition with stowage spaces arranged one above the other for the individual garbage fractions. In this case, the partitions are each arranged in the longitudinal direction of the garbage vehicle. The partition in the garbage vehicle is always continued into the dumping region of the vehicle and, in general, is in alignment with the partition of the applied multichamber garbage container.

As a consequence of this, EP-A-0,257,442 disclosed a multichamber garbage system which has a vertical partition in the vehicle, with a dumping orifice in alignment therewith, and, a partition for a garbage container to be applied correspondingly, with an adapted partition in the garbage container. In order to execute a tilting movement which has a pivot angle greater than 180°, there is provided a separating wall which forms an extension of the partition of the garbage container, in order to keep the garbage fractions separate until they are charged into the garbage vehicle.

As an alternative to this, EP-A-0,314,238 disclosed a further multichamber garbage system which comprises a vehicle and a multichamber garbage container and in which the vehicle has a horizontal partition. In this vehicle, the rear loading wall is designed in such a way that an upper and a lower charging orifice extending over the entire vehicle width are obtained. In this case, the upper vehicle stowage space is connected to the upper charging orifice and the lower vehicle stowage space is connected to the lower charging orifice. Since the parting plane of the upper and the lower charging orifices is not in alignment with the horizontal vehicle partition, a rigid auxiliary partition or sliding plate, which forms a kind of angled extension of the vehicle partition, is provided. This auxiliary partition or sliding plate then also forms the parting plane for the different garbage fractions, that is to say the partition of the garbage container is in alignment with the sliding plate during the charging operation, so as to connect the upper and the lower stowage space of the garbage vehicle in each case directly to the upper and the lower chamber of the garbage container. This garbage collection system also makes it possible, in addition to the controlled emptying of multichamber garbage containers, to empty so-called single-chamber containers having only one specific garbage fraction. For this purpose, the single-chamber garbage container is assigned with its container orifice to the respective dumping orifice on the vehicle, so that, for example, only the upper charging orifice or only the lower charging orifice is loaded with garbage in each case.

Furthermore, the known EP-B1-0,535,072 discloses a multichamber garbage collection and transport system, in which the dumping orifice on the vehicle is arranged essentially independently of the arrangement of the partition in the vehicle. This purpose is served by uncoupling the arrangement of the dumping orifice on the garbage vehicle from the arrangement of the partition for forming the stowage spaces in the vehicle. In order to lead the appropriate garbage fraction out of the garbage containers into the corresponding stowage space of the garbage vehicle, this known system has intermediate receptacles or feed devices which connect the respective dumping orifices to the respective stowage spaces in the garbage vehicle. As a result, the dumping orifices can be placed optimally on the vehicle, without there being a compulsory geometrical assignment to the stowage spaces in the vehicle. For example, the known system also has a horizontal longitudinal partition in the garbage vehicle, for example a dumping orifice being connected via a duct or connecting well to the lower stowage space of the garbage vehicle. To receive a further fraction, there is provided a loading trough which is pivotable about a horizontal axis of rotation and onto which the further garbage fraction is tipped via a corresponding dumping orifice and which, after executing an upward-directed pivoting movement, conveys the garbage fraction into the upper stowage space. Accordingly, in this known system, the loading trough serves for receiving a garbage fraction and for subsequently transporting it into the upper stowage space. In this case, the loading trough always has the function of partitioning off the lower stowage space during the operation of emptying the garbage container and of temporarily receiving the intercepted garbage fraction for further transport.

The disadvantage of the known devices is that they are restricted essentially to one system of construction. Admittedly, according to EP 0,314,238, both the multichamber garbage container and a single-chamber garbage container can be emptied. In this case, however, it is necessary to ensure that, when the multichamber garbage container is emptied, a strict assignment of the partitions both in the garbage vehicle and in the garbage container is maintained via the coupling of the dumping orifice.

An arrangement of a single-chamber garbage vehicle with a loading trough mounted on the tail part at the bottom and with a clearing shovel fastened to the tail part at the top was disclosed by DE-AS 1 023 395. In this arrangement, the lower loading trough with an attached wallpart serves solely for the intermediate reception of the garbage which is transported further by the separate clearing shovel.

Furthermore, DE 35 37 546 A1 disclosed a multichamber waste collection vehicle which has a plurality of stowage spaces located one above the other. In the front region of an intermediate bottom, a filling hatch for a stowage space located underneath is provided below a roof hatch closed by means of a cover. The disadvantage of this known device is that it is not possible for a plurality of sorts of garbage to be emptied simultaneously at different levels. Only one garbage sort for a specific stowage space in the garbage vehicle can be introduced in each case into the charging orifice provided on the roof of the vehicle.

SUMMARY OF THE INVENTION

The object on which the invention is based is, therefore, to develop further the essential idea of EP-B1 0,535,072 and to provide a garbage collection and transport system which can be used universally and in which the loading of a single-chamber or multichamber garbage vehicle is possible both by means of nonsubdivided single-chamber garbage containers and by means of subdivided multichamber garbage containers. When a multichamber garbage vehicle is used in conjunction with a multichamber garbage container, an essential uncoupling of the respective partitions present in the garbage vehicle and garbage container is to be possible. At the same time, as simple a technical device as possible for feeding the garbage out of the garbage containers to the stowage space in the garbage vehicle is to be provided, different garbage containers being capable of being used.

The object of the invention is, furthermore, to achieve the flexibility of the system by means of separate subassemblies on the vehicle.

ADVANTAGES OF THE INVENTION

The garbage collection and transport system according to the invention has in the first place, in the same way as EP 0,535,072, the advantage that a basic uncoupling of the arrangement of the dumping orifice on the garbage vehicle from the arrangement of the partition for the formation of stowage spaces in the garbage vehicle is provided. For this purpose, the present invention likewise employs the principle of an intercepting flap or loading trough pivotable about a horizontal pivot axis. The essential idea of the present invention is, inter alia, to use the loading trough, known per se, not only as an intercepting device per se, but as a variable loading and tidying device which at the same time forms a rear closure of the vehicle stowage space. As a result, different stowage spaces or even only one stowage space in the garbage vehicle can be loaded and handled independently of the remaining charging and dumping device on the vehicle tail part. In particular, a closed-off container design is also possible, in which case the intercepting flap or loading trough can be mounted either on the individual container or else also on the vehicle-bound dumping device or the tail part.

However, the loading trough preferably also serves as an extended partition of the vehicle partition itself, in order thereby to achieve individual adaption to the garbage container. In this case, the loading trough is a kind of variable partition of a dumping device itself, so that, depending on the applied garbage container, the loading trough can be aligned correspondingly with a partition or wall of the garbage container. In this case, both multichamber garbage containers and single-chamber containers can be emptied, since the loading trough can adapt to the respective wall sections.

Furthermore, the loading trough serves as a compacting flap for tidying the respective stowage spaces. By appropriate positioning, the loading trough is used as a rear closure of the tailboard, so that, for example, the tail part can be swung away, without the stowage space in the garbage vehicle being opened. The loading trough is therefore part of the rear tail closure of the vehicle stowage space.

In comparison with the prior art mentioned, the lower stowage space is therefore not obtained by means of a discharge well and a recess in the loading trough itself, but merely the appropriate positioning of the loading trough can bring about a separation of the stowage spaces, corresponding feedwells being formed in conjunction with the dumping device. The additional function of tidying the garbage and of a mutual influencing in each case of two loading flaps arranged one above the other improves the functioning of the system according to the invention. A particular advantage is afforded by a possible container design of the system, that is to say the arrangement of a plurality of containers one above the other is also possible.

In a development of the invention, there is a provision, in particular, in the case of a garbage vehicle with a horizontal longitudinal partition, for also making it possible, without difficulty, to empty multichamber garbage containers having transverse and/or longitudinally arranged partitions in the garbage container. This is carried out by a segmenting of the loading troughs in a width which is closely adapted to the particular chambers to be emptied in the garbage container, and, if necessary, by means of corresponding vertical intermediate wall sections for the lateral delimitation of the charging orifices located next to one another.

It is therefore also possible to handle a garbage container subdivided crosswise, that is to say fourfold. By means of appropriate positioning by means of vertical wall sections and, at the same time, a corresponding horizontal positioning of the loading troughs adapted to the width of the garbage container orifice, a controlled emptying of each of these chambers can be carried out.

In the case of an undivided stowage space, that is to say a single-chamber garbage vehicle, for example a reciprocal fastening of the approximately central loading trough or of a further, for example, upper loading trough to the container itself and/or to the loading tail can serve to ensure that even an undivided stowage space can be emptied without difficulty. The vehicle can thereby be used both as a multichamber and as a single-chamber garbage vehicle.

BRIEF DESCRIPTION OF THE DRAWINGS

Further particulars of the invention are presented in the drawings and are explained in more detail in the following description, with further advantages being indicated. In the drawings.

DESCRIPTION OF THE INVENTION

Figure 1:
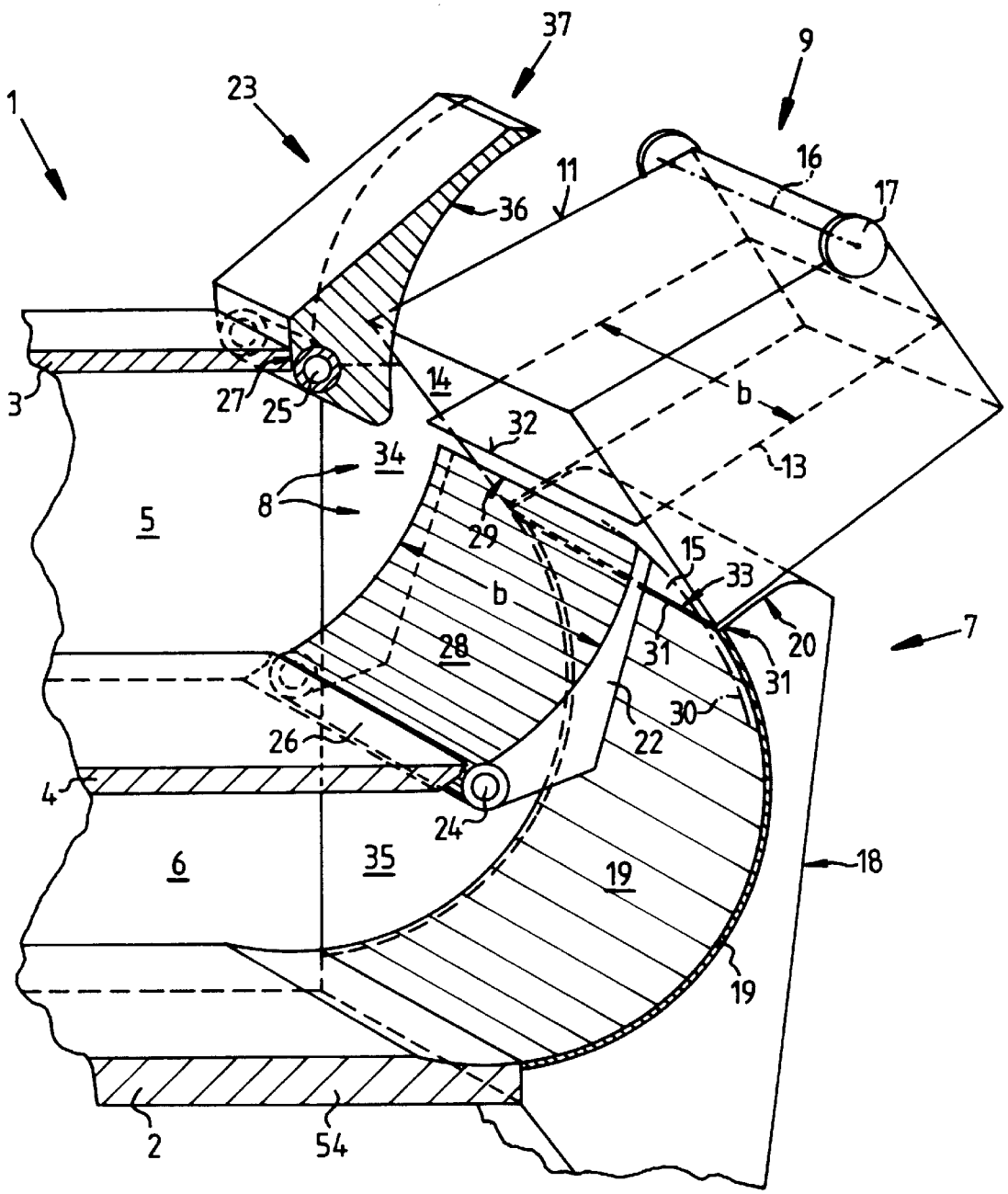
FIG. 1 shows a perspective representation of the tail part in a longitudinal section of the vehicle, with an applied garbage container having a transverse partition.
Figure 2:
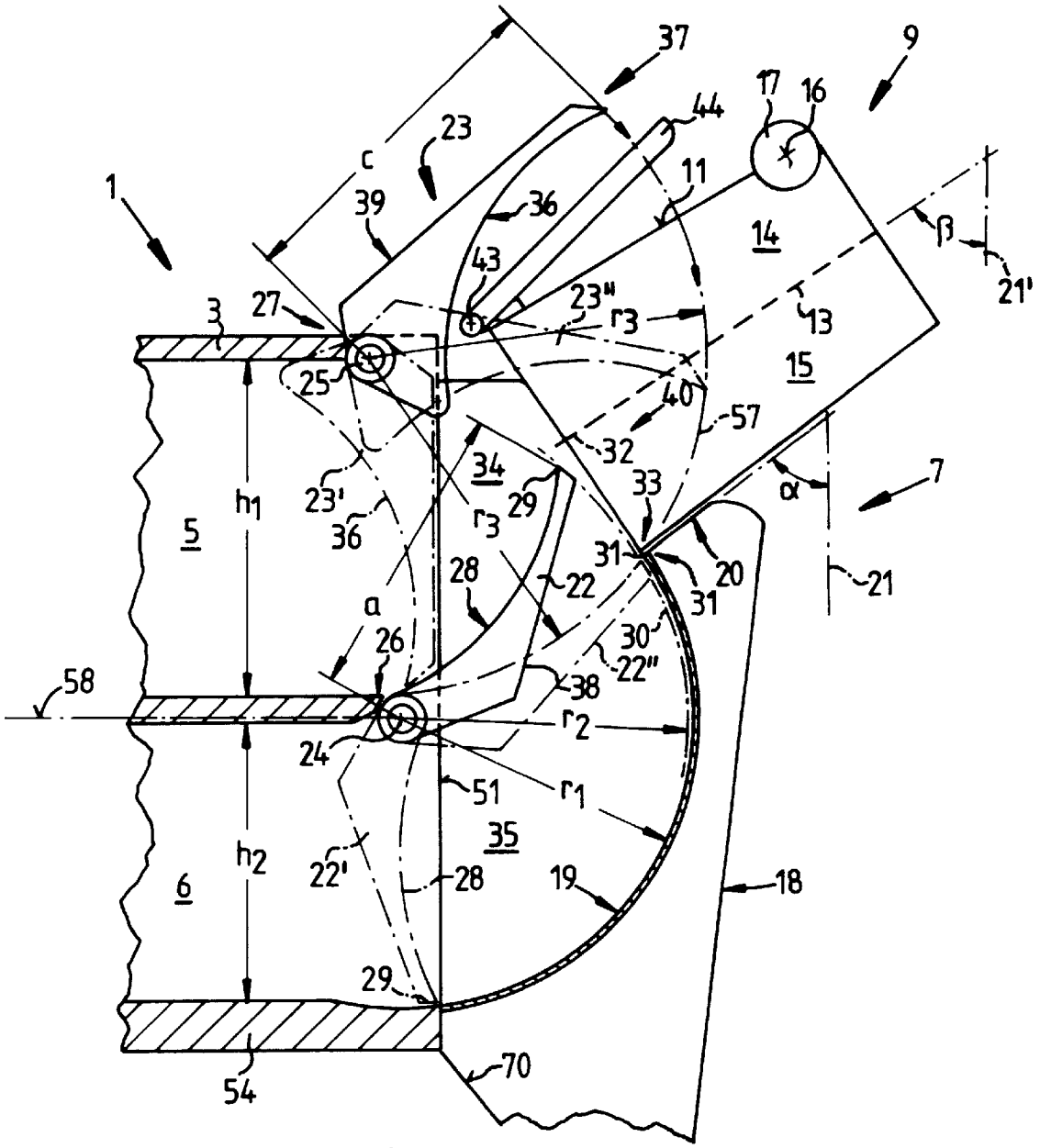
FIG. 2 shows a representation according to FIG. 1 in a side view.
Figures 10, 10A, 10B, 10C, 10D:
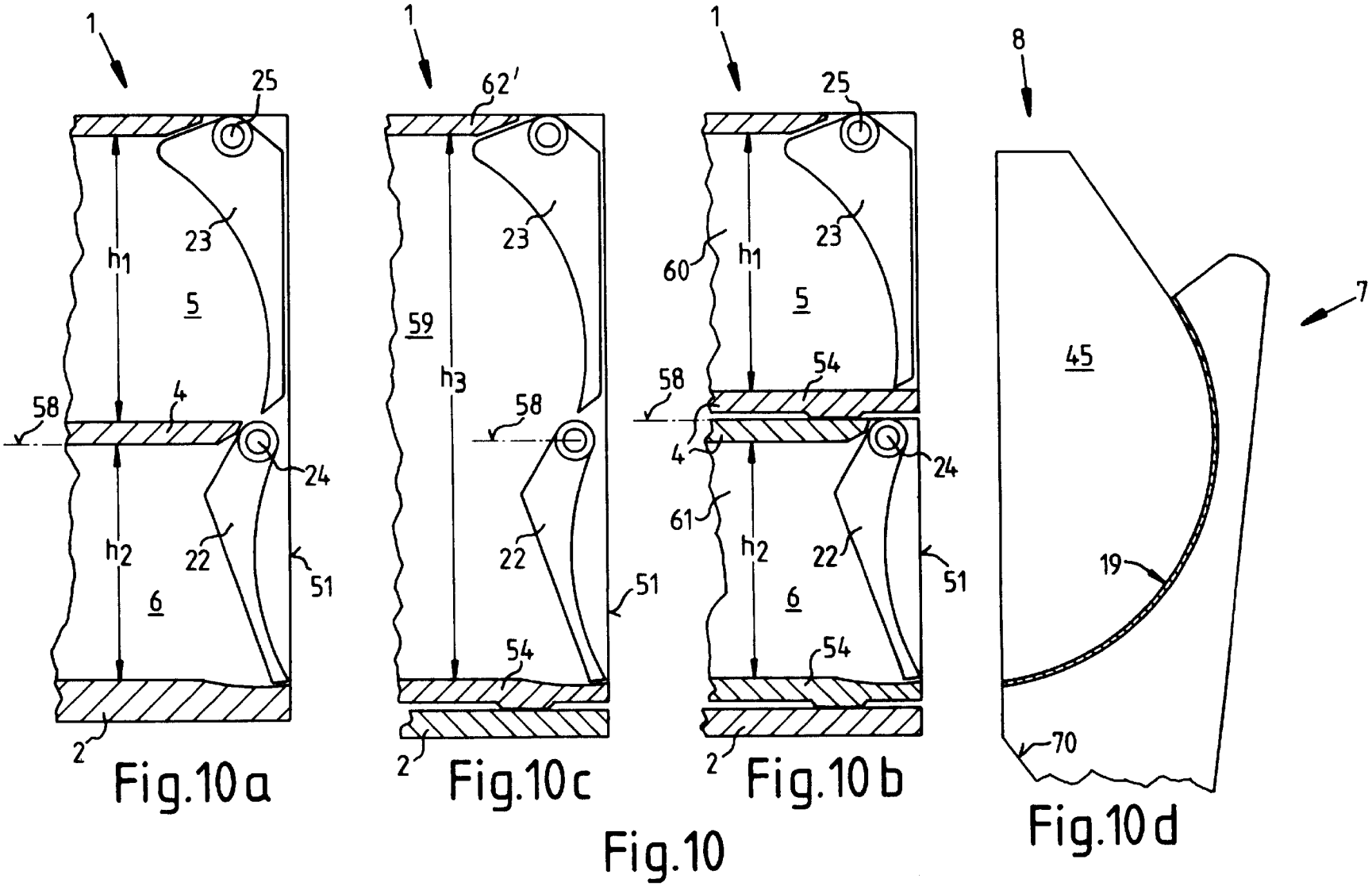
FIGS. 10*a*–10*e* show a diagrammatic representation of various types of garbage vehicles with an associated tail part.
Figure 10E:
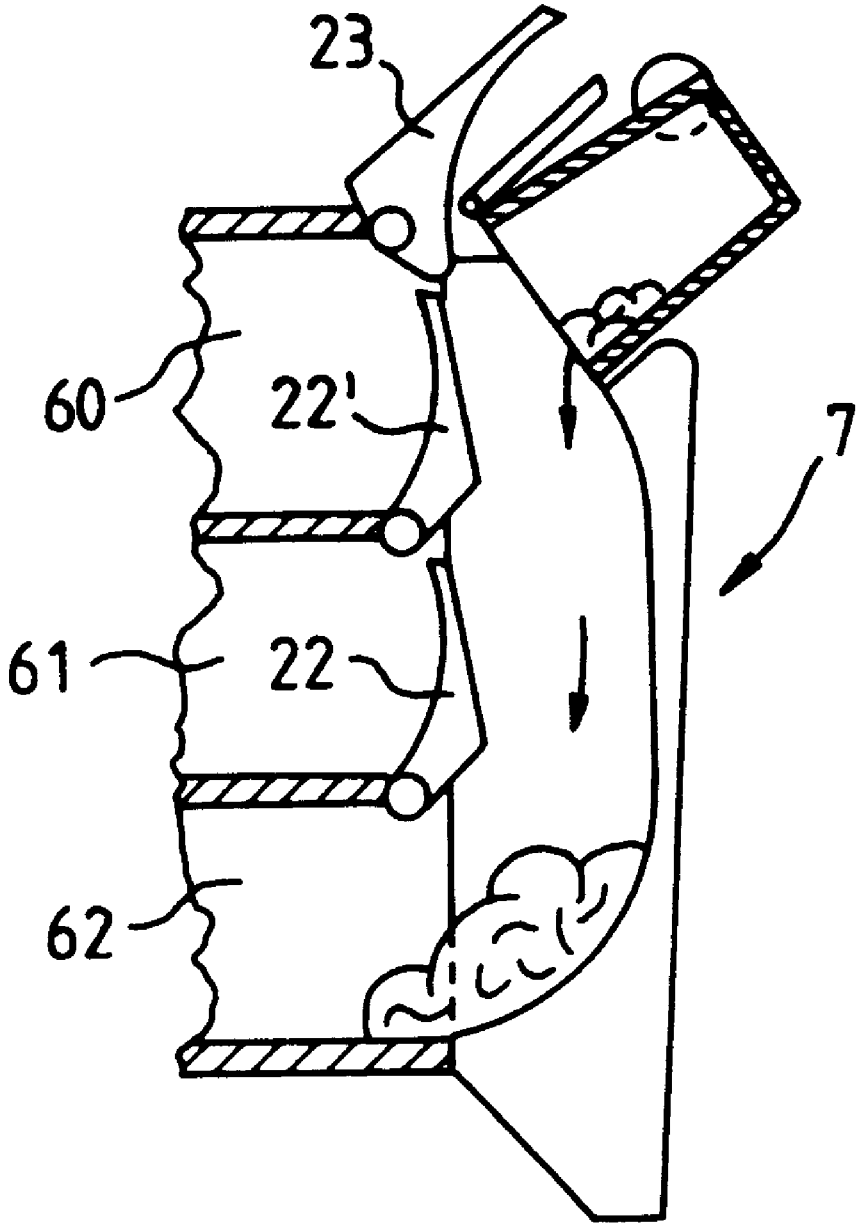

According to the perspective representation of a first exemplary embodiment in FIG. 1 or the associated side view in FIG. 2, the garbage vehicle 1 has a lower vehicle bottom 2, an upper vehicle roof 3 and a horizontal partition 4 running in the longitudinal direction of the vehicle, in order to divide the garbage vehicle into an upper stowage space 5 for receiving a garbage fraction A and a lower stowage space 6 for receiving a garbage fraction B. The stowage spaces 5, 6 can also be formed by two or more containers 60, 61, 62 placed one above the other, as shown in FIGS. 10*b* and 10*e*.

The tail part 7 or loading tail of the garbage vehicle is equipped with a charging or dumping device 8 which serves for feeding different waste materials separately from a garbage container 9 into the associated stowage space 5, 6 of the vehicle. The garbage container 9 can consist of a nonsubdivided "single-chamber" garbage container 10 (see FIGS. 4*a* to 4*d*). It can also be designed as a so-called multichamber garbage container 11, 12, in which the partition 13, displaceable if appropriate, subdivides the garbage container into, for example, two or more chambers 14, 15 for receiving the respective garbage fractions A, B.

In the exemplary embodiment according to FIGS. 1 to 3, the multichamber garbage container 11 has a transverse partition 13 which, when the garbage container is applied to the garbage vehicle, is oriented transversely relative to the tail part 7. It is also oriented parallel to the axis of rotation 16 of the running wheels 17 or parallel to the axis of rotation 43 of the cover 44 of the garbage container 11. In contrast to this, the multichamber garbage container 12, as represented in the exemplary embodiment according to FIGS. 5 to 7, has a longitudinally oriented partition 13' which, when the garbage container is applied to the garbage vehicle, is oriented in a vertical plane, that is to say perpendicularly relative to the tail part 7. These differently oriented partitions are explained in more detail in the literature initially acknowledged.

Figure 1A:
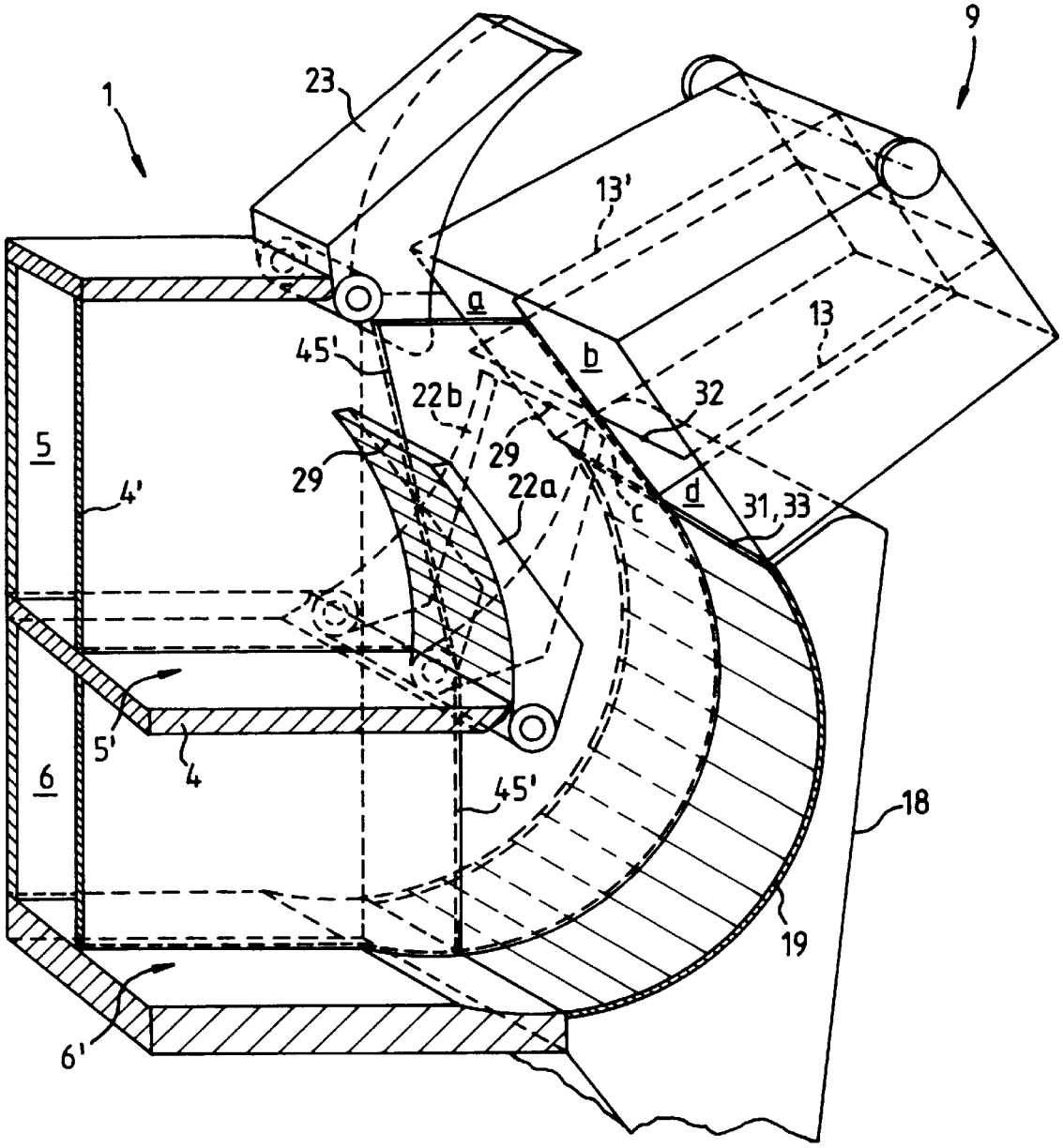
FIG. 1*a* shows a perspective representation, as in FIG. 1, but with a garbage container having a reception space subdivided cross-wise, namely fourfold, and with a correspondingly adapted garbage vehicle.

FIG. 1*a* shows, furthermore, a garbage container subdivided crosswise, with four individual chambers, as is also described in more detail below.

According to the representation in FIGS. 1 and 2, the rear region of the garbage vehicle possesses, furthermore, a tail part 7, the lower wall section 18 of which has an inner or closure wall 19 which faces into the vehicle interior and, in side view, is in the form of a circular segment or is cylinder-like. This cylindrical closure wall 19 constitutes the inner delimitation of the charging or dumping device 8 flanged to the garbage vehicle. The upper region of the wall section 18 is designed as a bearing surface 20 for the garbage container 9, with an angle a $\alpha \approx 50°$ relative to a vertical plane 21 which is oriented parallel to the tail part 7 of the garbage vehicle. In this case, the angle of inclination a corresponds approximately to the angle of inclination $\beta$ of the inclination of the partition 13 in FIG. 2 relative to a corresponding vertical plane 21'.

As is evident from FIGS. 1 and 2, the garbage vehicle 1 possesses, furthermore, two platform devices which serve as loading or tidying devices 22, 23 and which are also referred to as loading troughs or loading flaps. In this case, a first pivotable loading trough 22 having the horizontal pivot axis 24 is arranged in the region of the rear closure 26 of the horizontal partition 4. The upper loading trough 23 is likewise positioned with its horizontal pivot axis 25 in the region of the rear closure 27 of the upper vehicle roof 3.

In the exemplary embodiment according to FIGS. 1 and 2, two loading troughs 22, 23 of this type are in each case arranged next to one another on the garbage vehicle 1, so that the representation according to FIGS. 1 and 2 shows a mid-longitudinal section through the vehicle. In the exemplary embodiment according to FIGS. 1 to 4, therefore, each garbage container 9 is assigned in each case two loading troughs 22, 23 located next to one another. If, for example, two garbage containers 9 having a transverse partition are applied next to one another to the dumping device 8, it is correspondingly necessary to have two loading troughs 22, 23 located next to one another.

The lower loading trough 22 shown in FIGS. 1 and 2 has an upper loading surface 28 which is arcuate or planar in cross-section and the free end or end edge 29 of which runs around the pivot axis 24, on an imaginary circular-cylindrical surface 30. In this case, the cylindrical surface 30 spanned by a circle runs parallel and closely next to the closure wall 19 which is in the form of a circular segment in cross-section. The closure wall 19 in the form of a circular segment therefore forms a radius $r_1$ about the axis of rotation 24, the radius $r_1$ being equal to or somewhat larger than the radius $r_2$ of the circular-cylindrical surface 30.

The imaginary or spanned circular-cylindrical surface 30 is extended beyond the upper closure edge 31 of the closure wall 19, so that the loading trough 22 can extend with its end edge 29 at least into the middle region of the garbage container 9, 11. At the same time, the multichamber garbage container 9 is applied obliquely to the dumping device 8 in such a way that the partition 13 of the garbage container 11 has its end-face closure edge 32 approximately in alignment with the end edge 29 of the loading trough 22. The projected length a (FIG. 2) of the loading surface 28 of the loading trough 22 from the pivot axis 24 as far as the end edge 29 or the radius $r_2$ is therefore dimensioned in such a way that it can approximately reach the closure edge 32 of the partition 13 of the multichamber garbage container 11. This is achieved, in particular, by means of the tilting movement of the garbage container 11 through the angle $\beta$ on the dumping device 8.

By virtue of the arrangement of the loading trough 22 in alignment with the partition 13, both in its longitudinal arrangement and in its width b, the content, for example the garbage fraction A, passes out of the upper chamber 14 of the multichamber garbage container 11, said upper chamber being represented in FIGS. 1 to 3, onto the loading surface 28 and can be fed from there to the upper storage space 5 of the garbage vehicle 1, the upper stowage space being intended for receiving the garbage fraction A. The loading trough 22 therefore constitutes an extended partition of the horizontal partition 4 in the garbage vehicle, the end edge 29 of the loading trough being capable of being applied to the closure edge 32 of the partition 13 of the multichamber garbage container 11. Likewise, for example, the further garbage fraction B passes out of the lower chamber 15 of the multichamber garbage container 11, the lower chamber being represented in FIGS. 1 to 3, via the closure wall 19 of circular cross-section as a sliding surface or discharge well 35, to the lower stowage space 6 of the garbage container 1, since the upper closure edge 31 of the closure wall 19 is in alignment with the end-face front side edge 33 of the applied garbage container 11.

The loading trough 22 therefore forms, in its upper region, a passage well 34 for the upper garbage fraction A in the garbage container 11 and a lower passage or discharge well 35 for the lower garbage fraction B arranged in the garbage container 11.

Furthermore, according to the representation in FIGS. 1 and 2, the upper loading trough 23, which has a downward-directed wall section 36 in the form of a circular arc in cross-section, is provided. The outer end edge 37 of the upper loading trough 23 is arranged at a distance c from the pivot axis 25 which corresponds to the pivoting radius $r_3$ on the circular arc 57. This distance c corresponds approximately to the inner height $h_1$ of the upper stowage space 5. Likewise, the distance a between the points 24, 29 of the loading trough 22 corresponds approximately to the height $h_2$ of the lower stowage space 6. This emerges from the loading troughs 22', 23' marked by broken lines in FIG. 2. The vertically set loading troughs 22', 23' thereby form a rear closure of the garbage vehicle 1 for closing the stowage space chambers 5, 6.

Both the loading trough 22 and the loading trough 23 are designed with V-shaped cross section in their wall sections 38, 39 located respectively opposite the circular wall sections 28, 36, in order to achieve a high load-bearing force or surface pressure force on the respective surfaces of the loading troughs 22, 23. This is required, in particular, for compacting the garbage introduced into the stowage spaces 5, 6 by the corresponding surfaces of the loading troughs 22, 23, that is to say these loading troughs serve the same as compacting flaps for these stowage spaces 5, 6.

In FIG. 2, the loading trough 22 is shown in alignment with the partition 13 of the garbage container 11. In a further position represented by broken lines, the loading trough 22" is represented with its end edge 29 in alignment with the end-face horizontal front side edge 33 of the garbage container 11, so that the other garbage fraction contained in the chamber 11 would also be emptied only into the upper stowage space 5. The loading trough 22" consequently closes off the lower passage well 35. This could be necessary if the entire contents of the upper garbage container 9, 11 is to be introduced into the upper stowage space 5. In particular, this also applies to emptying a single-chamber garbage container also to be described below.

Figure 3A:
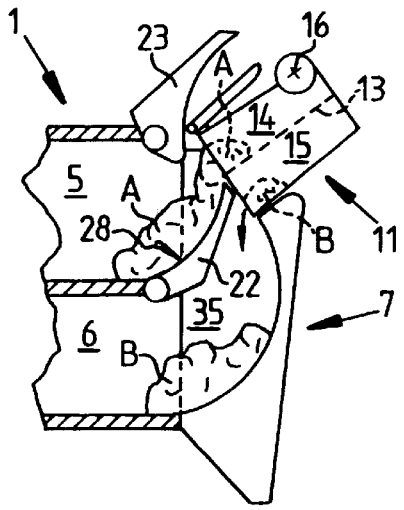
FIGS. 3*a*–3*d* show the work cycle during the emptying of a garbage container having a transverse partition into a garbage vehicle according to FIG. 1 or FIG. 2, FIGS. 4*a*–4*d* show the cycle of movement for emptying a single-chamber garbage container into a vehicle according to FIGS. 1 and 2.
Figure 3B:
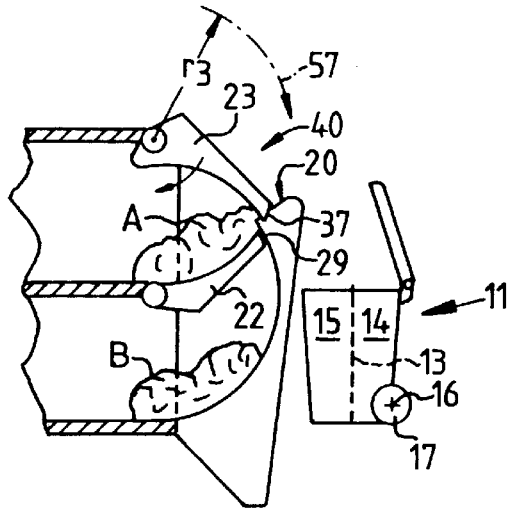
Figure 3C:
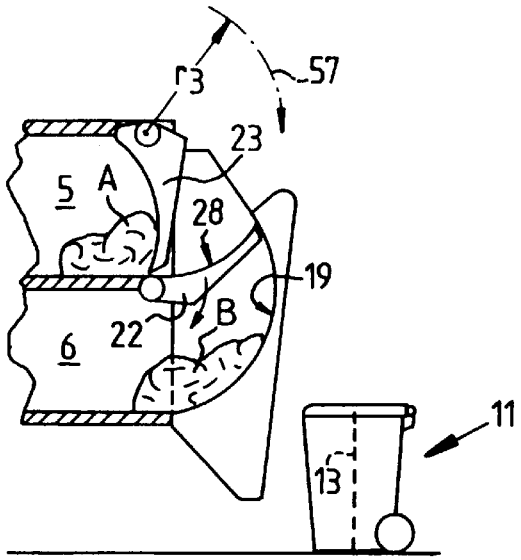

The emptying cycle for a multichamber garbage container 11 having a transversely oriented partition 13 is shown once again in more detail in FIGS. 3*a* to 3*d*. In this case, FIG. 3*a* corresponds to the representation of the arrangement according to FIGS. 1 and 2. Here, the loading trough 22 is oriented in alignment with the partition 13, so that the upper garbage fraction A passes from the upper chamber 14 of the garbage container 11 through the Loading surface 28 to the upper stowage space of the garbage vehicle 1. Likewise, according to the representation in FIG. 3*a*, the garbage fraction B passes from the lower chamber 15 of the garbage container 11 through the lower passage or discharge well 35 into the lower stowage space 6 of the garbage vehicle 1. When the two chambers 14, 15 are emptied, the multichamber garbage container 11 is removed from the upper dumping/charging orifice 40. The loading trough 22 is then first pivoted downward clockwise until the free end edge 29 and therefore the cylindrical surface 28 are approximately in alignment with the circular arc 57 of the outer end edge 37 of the upper loading trough 23. This corresponds approximately to the position of the loading trough 22" represented by broken lines in FIG. 2. The upper loading trough 23 can then likewise be rotated clockwise, so that its outer end edge 37 sweeps past approximately in the region of the bearing surface 20, as shown in FIG. 3*b*. From this position, as a result of further clockwise rotation of the upper loading trough 23, the garbage fraction A is then cleared off from the loading surface 28 of circular cross-section of the loading trough 22, as shown in FIG. 3*c* in the lower end position of the loading trough 23. Designing the loading surface 28 of the lower loading trough 22 in the form of a circular arc therefore has the advantage that the outer end edge 37 of the upper loading trough 23 can slide off on it.

However, the lower loading trough 28 can also be designed with a planar surface 28. This planar loading surface 28 can likewise be cleared off by means of adapted movement kinematics between the upper loading trough 23 and lower loading trough 22.

Figure 3D:
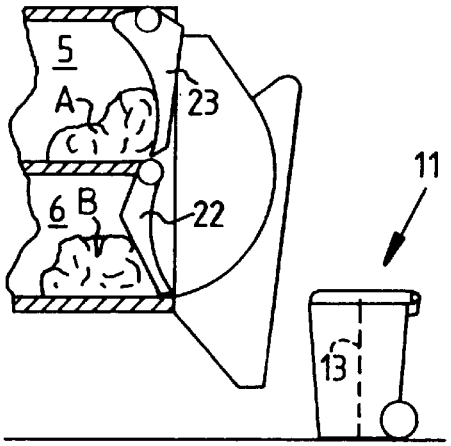

The representation according to FIG. 3*d* shows the subsequent pivoting movement of the lower loading trough 22, in order, by clockwise rotation, to tidy the lower garbage fraction B into the lower loading space 6. The two loading troughs 22, 23 accordingly cooperate in their geometrical arrangement for the purpose of tidying the upper garbage fraction A into the upper stowage space 5. Furthermore, the lower loading trough 22 clears the lower garbage fraction B into the lower stowage space 6 along the closure wall 19 of circular cross-section. The two loading troughs 22, 23 can compact the garbage introduced in each case into the stowage spaces 5, 6. FIG. 3*d* shows the state of the stowage spaces 5, 6 in which they are closed by the loading troughs 22, 23.

The emptying operation according FIG. 3*a* to 3*d* can take place in each case with two multichamber garbage containers arranged next to one another. In this instance, each garbage container 11 is assigned a flap arrangement 22, 23. This corresponds to the representation according to FIG. 1, with a vehicle body divided in the vertical longitudinal mid-plane. An arrangement of this type is provided in duplicate one next to the other and can be interconnected for larger containers.

Figure 4A:
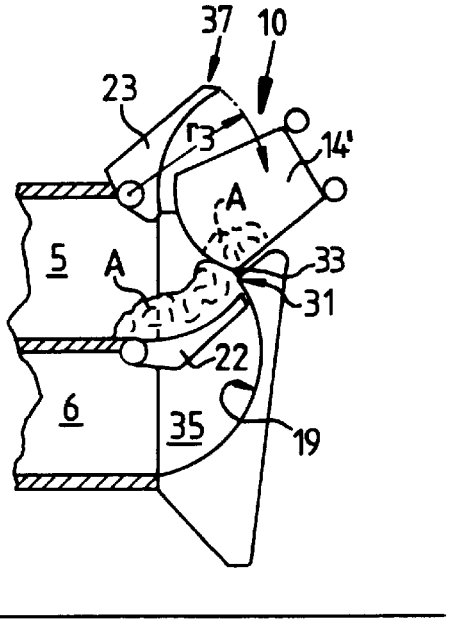
Figure 4B:
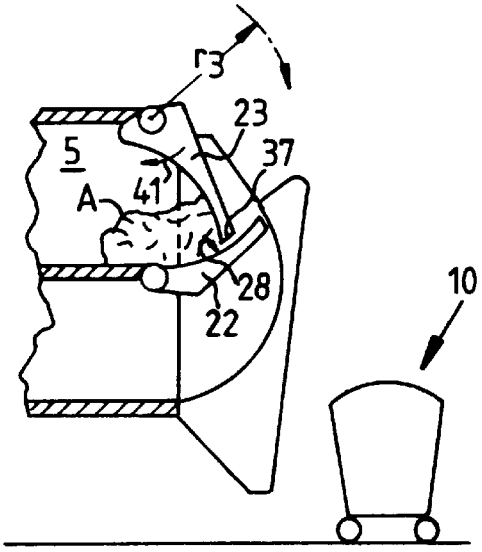
Figure 4C:
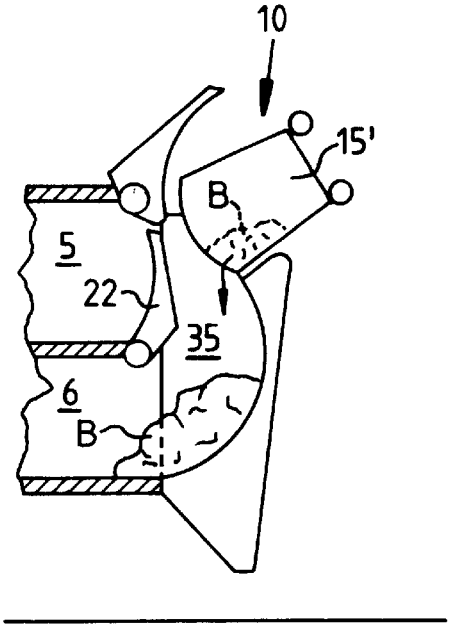
Figure 4D:
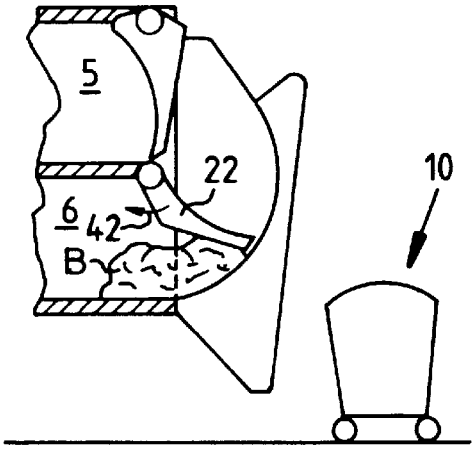

The representation according to FIGS. 4*a* to 4*d* shows the same multi-chamber garbage vehicle as described previously, but which serves for emptying a so-called single-chamber garbage container, that is to say a garbage container without an intermediate partition for receiving only one specific garbage fraction. For example, the single-chamber garbage container 10 in FIGS. 4*a*, 4*b* is intended only for receiving the garbage fraction A, whilst the single-chamber garbage container 10 in FIGS. 4*c*, 4*d* is intended for receiving a single fraction B. Consequently, according to the exemplary embodiment in FIGS. 4*a*, 4*b*, the lower loading trough 22 is positioned in such a way that it comes to rest at or underneath the closure edge 31 of the inner closure wall 19 having a cross section in the form of a circular arc.

This corresponds to the position 22" represented by broken lines in FIG. 2. The entire contents of the fraction A from the single-chamber garbage container 10 can thereby strike the loading surface 28 of the loading trough 22. The loading trough 22 consequently shuts off the downward-directed passage well 35 to the lower storage space 6.

According to the representation in FIG. 4*b*, in a second operation the loading trough 22 is once again emptied by means of a clockwise pivoting movement of the upper loading trough 23 (arrow 41), so that the garbage fraction A is transported into the upper stowage space 5. The lower loading trough 22 is one again positioned in such a way that the free end 37 of the upper loading trough 23 can sweep along the loading surface 28. In the clearing-off position, therefore, the loading surface 28 lies approximately on a circumscribed circle 57 of the outer end edge 37 having the circle radius $r_3$.

The single-chamber garbage container 10 in FIGS. 4*c*, 4*d* is intended, in contrast, for receiving the other garbage fraction B. In order to convey the fraction B into the lower vehicle stowage space 6, according to the representation in FIG. 4*c*, the loading trough 22 is arranged so as to be pivoted upward to such an extent that the fraction B can fall through, unimpeded, into the discharge well 35. According to the representation in FIG. 4*d*, the discharge or passage well 35 is then emptied as a result of a clockwise pivoting movement of the loading trough 22 (arrow 42), so that the fraction B is introduced into the lower stowage space 6 for this fraction (see FIG. 4*d*).

The arrangement according to FIGS. 4*a* to 4*d* can likewise be used in duplicate, that is to say one next to the other on the garbage vehicle. This corresponds to a garbage container according to the representations in FIGS. 1 and 2, but without a partition in the garbage container. In this case, once again, it is necessary in each case to have two loading troughs 22 and 23 which are located next to one another and which, in general, can be actuated independently of one another. This applies particularly to the lower loading trough 22 for partitioning off the lower passage shaft 35. For individually clearing of the loading surface 28 of the respective loading trough 22, it may also be expedient to provide upper loading troughs 23 which can in each case be actuated independently of one another. However, with an appropriate arrangement and positioning of the lower loading trough 22, this can also be carried out by means of a one-piece upper loading trough 23 extending over the entire vehicle width.

Figure 5:
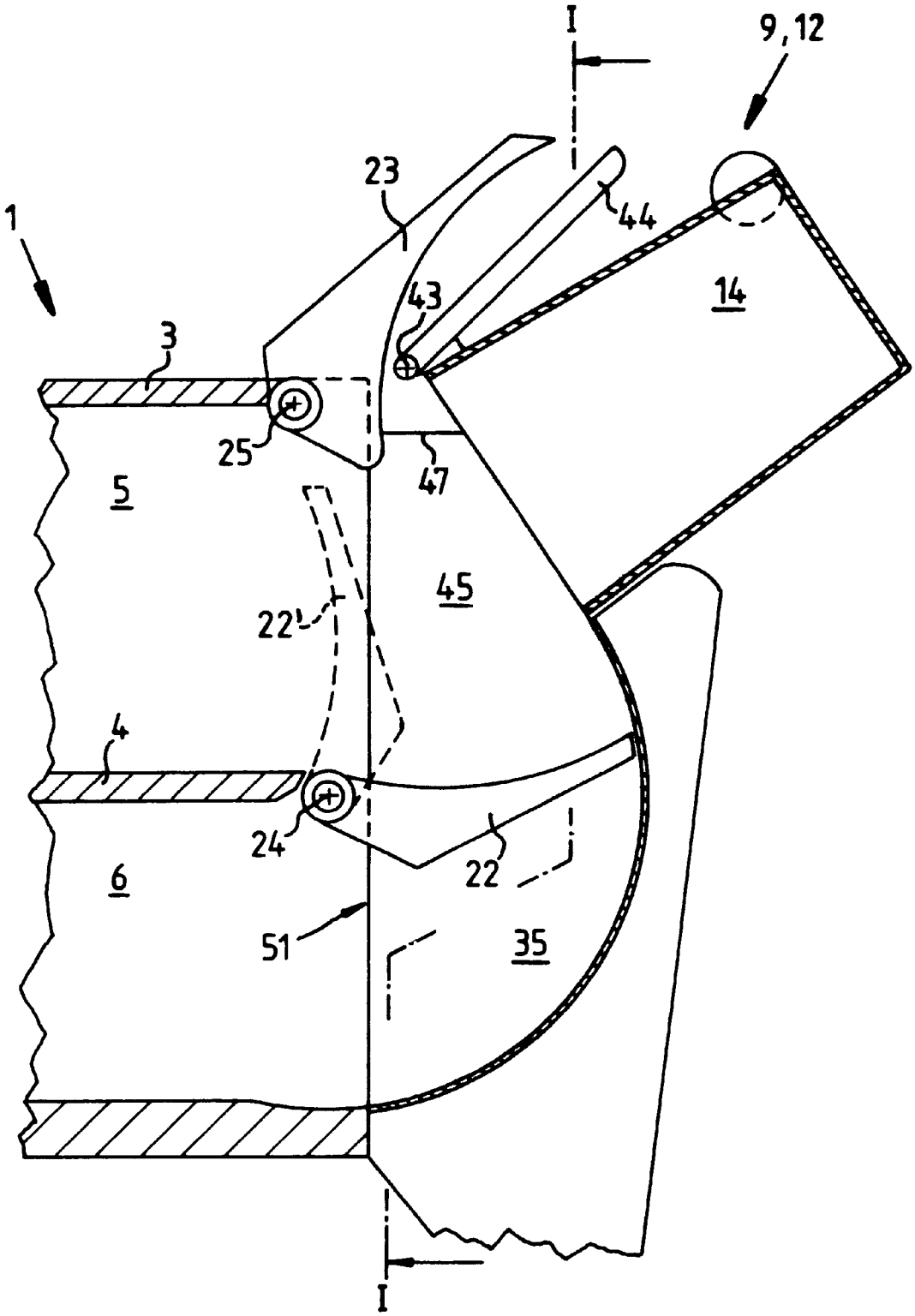
FIG. 5 shows a longitudinal section through a garbage vehicle for the emptying of multichamber garbage containers having a longitudinal partition.
Figure 6A:
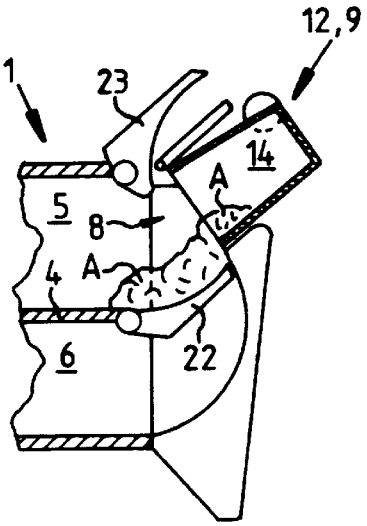
FIGS. 6*a*–6*d* show the cycle of movement for emptying the multichamber garbage container having a longitudinal partition.
Figure 6B:
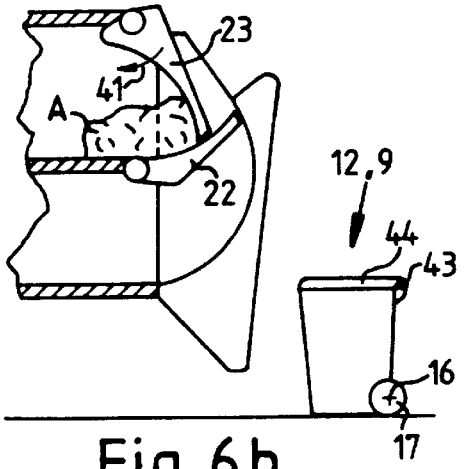
Figure 6C:
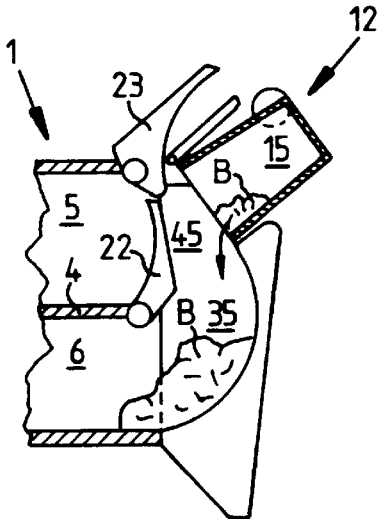
Figure 6D:
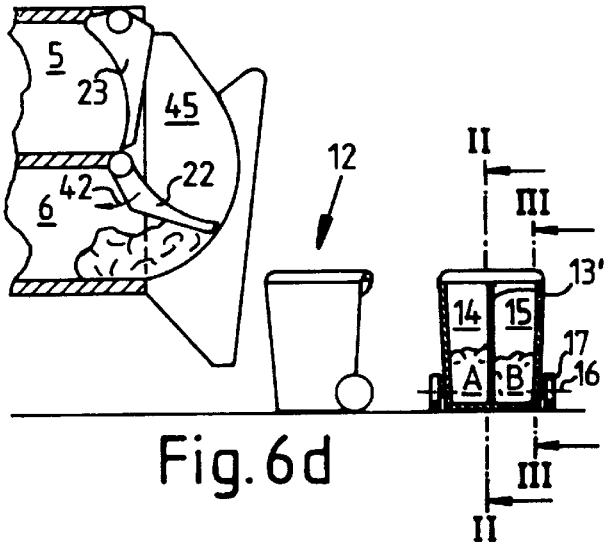

The exemplary embodiment of the invention according to FIGS. 5 to 7 shows a garbage vehicle 1 serving for the emptying of multichamber garbage containers 9, 12 which, however, are equipped with a longitudinal partition 13' arranged perpendicularly relative to the garbage vehicle, as shown by the additional sectional representation in FIG. 6*d*. Here, therefore, the partition 13' is arranged perpendicularly relative to the axis of rotation 16 of the running wheels 17, in order to form the two chambers 14, 15 located next to one another. The axis of rotation 16 is parallel to the axis of rotation 43 of the garbage container lid 44.

The representation of FIG. 5 and of FIG. 6*a* consequently shows a multichamber garbage container 12 corresponding to the sectional line II—II in FIG. 6*d*, that is to say a side view of the garbage container chamber 14 for receiving the garbage fraction A. This garbage fraction A is intended to be received in the upper stowage space 5 of the garbage vehicle 1, so that the loading trough 22 in FIG. 6*a*, according to its position shown, has to intercept this garbage fraction A. According to the representation in FIG. 6*b*, the loading trough 22 is once again emptied by means of a clockwise rotational movement of the upper loading trough 23 (arrow 41).

During this operation of dumping the garbage fraction A and emptying it out of the chamber 14, the garbage fraction B must also simultaneously be disposed of from the chamber 15 located next to it. This is represented in FIGS. 6*c*, 6*d* which show a section through the garbage container 12 corresponding to the sectional line III—III in FIG. 6*d*. The garbage container chamber 15 therefore has to be assigned different loading flaps 22 or 23 from the garbage container chamber 14, since the fraction B is to pass out of the chamber 15 into the lower stowage space 6 of the garbage vehicle 1. Consequently, according to the representation in FIG. 6*c*, the lower loading trough 22 is swung upward completely, in order to open the discharge well 35 for the garbage fraction B. whilst the loading trough 23 in FIG. 6*c* is arranged in the same position as in FIG. 6*a*. It can therefore be designed in one piece. The garbage fraction B is then tidied into the stowage space 6 by means of the clockwise pivoting movement of the loading trough 22 (arrow 42) (FIG. 6*d*).

So that the garbage fractions A, B can be handled independently of one another, it is necessary, furthermore, that the partition 13' of the garbage container 12 be continued in the region of the dumping device 8, so that the fractions A, B remain separate from one another even when they are thrown into the charging or dumping device 8. Consequently, for this purpose, a partition 45 is provided in the charging or dumping device 8, said partition being arranged in its positioning exactly as an extension of the partition 13'.

Figure 7A:
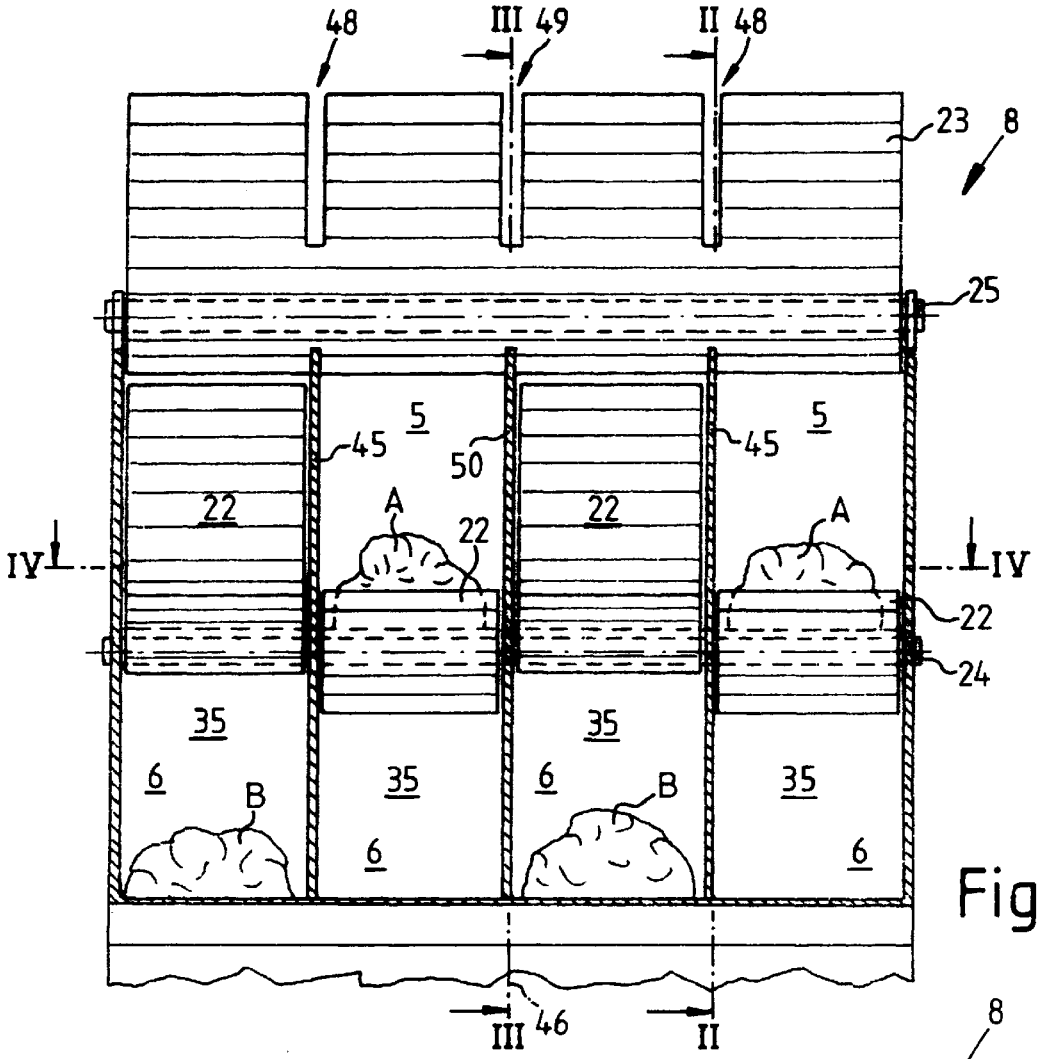
FIGS. 7*a*, 7*b* show respectively a rear view and a rear top view of the representation according to FIG. 5.
Figure 7B:
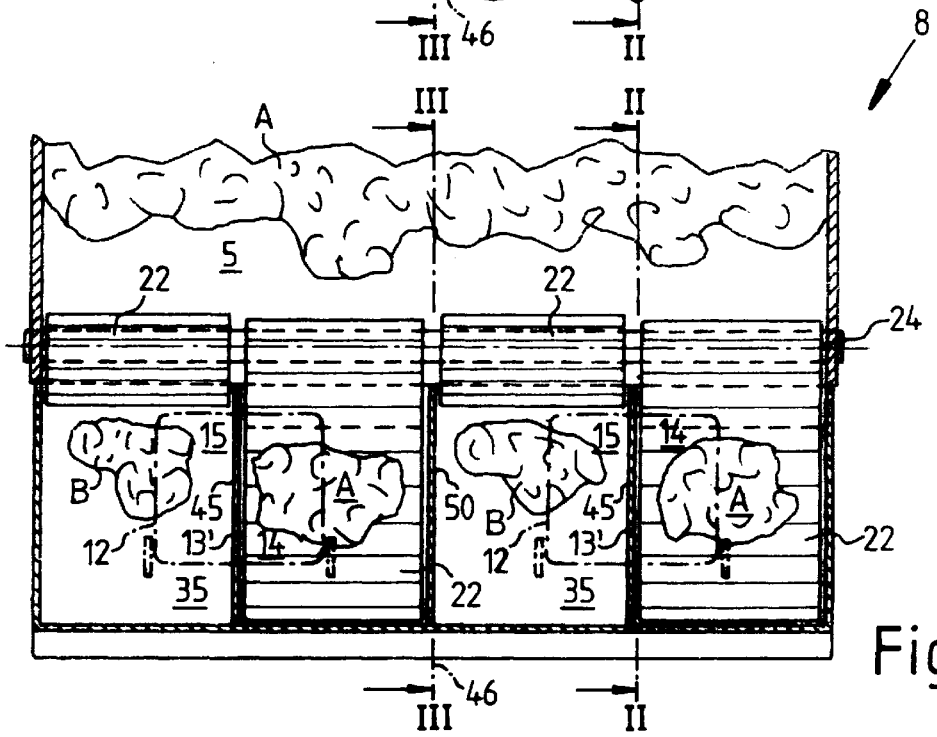

FIG. 7*a* shows a rear view of the charging or dumping device 8 according to the sectional representation I—I in FIG. 5. FIG. 7*b* shows a sectional representation IV—IV in FIG. 7*a*, that is to say a top view of the charging or dumping device 8.

According to the representation in FIGS. 7*a*, 7*b* as a rear view of the garbage vehicle, the latter is designed for receiving two multichamber garbage containers 12 arranged next to one another (see FIG. 7*b*). Each garbage container contains a central partition 13', said partitions being oriented parallel to the vertical longitudinal mid-plane 46 of the garbage vehicle 1. Each garbage container 12 contains a right-hand chamber 14, shown in FIG. 7*b*, for a garbage fraction A and a left-hand chamber 15 for a garbage fraction B. Each partition 13' of the multichamber garbage container 12 is extended, in the region of the dumping device 8, by the partition 45 which extends with its upper end 47 virtually as far as the vehicle roof 3 of the garbage vehicle 1. At all events, it has to be drawn upward to such an extent that the full garbage content of the fractions A, B remains separated one from the other when the garbage container is tipped out. Said partition can, if appropriate, also be pivoted away in its upper region out of the discharge region, in order to avoid obstructions when the garbage of, for example, a single-chamber container is thrown out. In the two associated FIGS. 7*a*, 7*b*, the operation of emptying the garbage container 12 according to the representation of FIGS. 6*a* to 6*d* is shown in the right-hand half of the figures, that is to say on the right of the vertical longitudinal mid-plane 46. In this case, the sectional line II—II in FIGS. 7*a*, 7*b* shows the emptying of the right-hand chamber 14 of the garbage container 12 according to the representations in FIGS. 6*a*, 6*b*, that is to say the lower loading trough 22 is located approximately in a horizontal position for receiving the fraction A from that chamber of the garbage container which is on the right in FIG. 7*b*, whilst the upper loading trough 23 is pivoted upward. This corresponds to the representation in FIG. 5 or FIG. 6*a*. Likewise, the left-hand chamber 15 of the garbage container 12, on the right in FIGS. 7*a*, 7*b* and having the fraction B, is emptied in that the associated loading trough 22 is pivoted upward, as represented in FIG. 6*c* according to the section III—III in FIGS. 7*a*, 7*b*. The fraction B can thereby fall down out of the chamber 15 into the discharge well 5 without difficulty. Here, too, the upper loading trough 23 is in its upper position. As is evident from FIG. 7*a*, the upper loading trough 23 extends in one piece over approximately the entire vehicle width B, that is to say the upper loading trough 23 is actuated as a whole via a corresponding drive so as to execute a rotational movement about the pivot axis 25. For this purpose, the upper loading trough 23 has two longitudinal slots 48 and a central longitudinal slot 49 which do not impede movement along the partitions 45 or along a central partition 50 in the vertical longitudinal plane of symmetry 46.

The region shown on the left of the vertical longitudinal plane of symmetry 46 in FIGS. 7*a*, 7*b* is designed identically, for receiving a second garbage container, with a corresponding flap arrangement of the loading troughs 22. Once again, an approximately horizontally oriented right-hand loading trough 22 for receiving the fraction A from the chamber 14 of the garbage container 12 and an approximately vertically oriented loading trough 22 arranged next to the right-hand loading trough 22 are provided, according to the representation in FIG. 6*c*, for the purpose of opening the passage well for the fraction B from the chamber 15 of the garbage container 12. The garbage vehicle therefore has four loading troughs 22 which are located next to one another and can be actuated independently of one another and which are each brought into a position which allows a garbage fraction A to be intercepted for transporting to the upper stowage space 5 of the garbage vehicle 1, or into a corresponding vertical position, so that a garbage fraction B passes through the discharge well 35 into the lower stowage space 6.

The arrangement according to FIGS. 5 to 7 is, of course, also suitable for emptying a garbage container according to the representation in FIGS. 1 to 3 which has a transversely arranged partition 13. In this case, the two loading troughs on the right and left of the longitudinal mid-plane 46, which are in each case located next to one another, would have to be actuated jointly in each case. The two flaps then behave in the same way as a one-piece folding flap 22.

Of course, the arrangement according to FIGS. 5 to 7 can also be used for emptying a single-chamber garbage container, as described with reference to FIGS. 4*a* to 4*d*. Here, too, the two loading troughs 22 arranged in each case on the right and left of the vertical longitudinal mid-plane 46 are connected rigidly to one another, so that they can be pivoted jointly in their position.

The upper loading trough 22 can, if required, also be divided into four individual segments. In general, however, a one-piece design is sufficient in order to make it possible for the in each case lower loading troughs 22 to be cleared off. is The partitions 45, 50 extend only in the region of the charging or dumping device 8, that is to say approximately as far as the vertical closure line 51 in FIGS. 2 and 5. The preceding loading space or stowage space of the garbage vehicle is divided merely into the upper stowage space 5 and the lower stowage space 6 without further intermediate walls. This is evident from the top view according to FIG. 7*b*.

Figure 8:
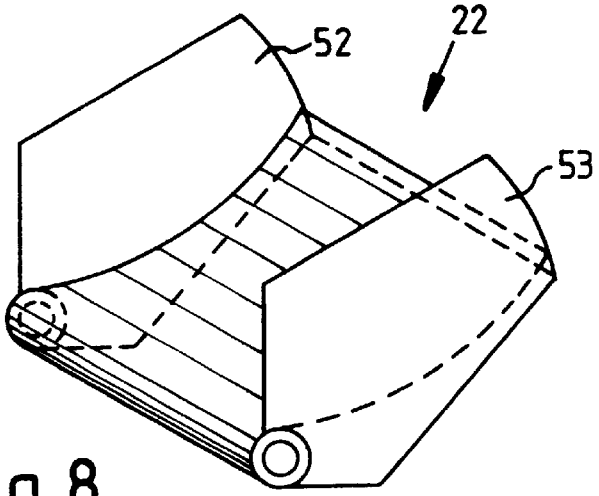
FIG. 8 shows an alternative design of a loading trough with applied side walls.

The exemplary embodiment according to FIG. 8 shows an alternative form of construction of a loading trough 22, in which wall sections 52, 53, in each case arranged on both sides and running in a vertical plane, are provided. These wall sections replace the partitions 45 and 50 in the exemplary embodiment according to FIGS. 5 to 7, so that the garbage fraction A delivered onto the loading trough 22 remains on the loading trough until the latter is emptied. The wall sections 52, 53 then likewise execute the pivoting movement of the loading trough 22. By means of these wall sections 52, 53, the loading trough 23 is designed to be shovel-shaped like a container.

In a development of the above-described exemplary embodiment, according to the representation in FIG. 1*a*, a combination of the arrangement of the partitions in the garbage container according to FIGS. 3*a* to 3*d* having a transverse partition and FIGS. 5 to 7 having a longitudinally oriented partition can be used. The exemplary embodiment according to FIG. 1*a* therefore has a garbage container 9 subdivided crosswise, with a transverse first partition 13 and with a longitudinal second partition 13' oriented in a vertical plane. These two partitions form the chambers a, b, c, d, for example of equal size, in the garbage container in FIG. 1*a*, to which stowage spaces 5, 5' and 6, 6' in the garbage vehicle are assigned.

So that the four chambers a to d of this garbage container can be emptied, once again the lower loading trough 22 is subdivided into two segments 22*a*, 22*b* which are located next to one another and which each have approximately half the width of the upper section of the transverse partition 13 in the garbage container 9 or approximately half the width of the garbage container orifice. Consequently, these two loading troughs can in each case aim with their front edge 29 at the front closure edge 32 of the transverse partition 13 or the lower closure edge 33 of the garbage container 9.

In order to obtain separation also with regard to the longitudinally oriented partition 13' in the garbage container 9, furthermore, a vertically oriented partition 45' is likewise provided in the dumping orifice, said partition being in alignment with a longitudinally oriented partition 13' in the garbage container. This corresponds to the described arrangement according to FIGS. 7*a*, 7*b*.

In the exemplary embodiment according to FIG. 1*a*, the upper tidying device or loading trough 23 can be designed in a similar way to the exemplary embodiment according to FIGS. 7*a*, 7*b*, a width corresponding to that of the lower loading trough 22*a* or 22*b* being selected in the exemplary embodiment according to FIG. 1*a*.

In the exemplary embodiment according to FIG. 1*a*, depending on the position of the loading trough 22 the garbage of the upper chamber a of the garbage container is transported into the upper stowage space 5 and the garbage from the chamber c located underneath is transported into the lower stowage space 6, the partition 45' separating the entire height of the rear dumping arrangement 19. Consequently, the stowage space of the garbage vehicle is subdivided into four corresponding chambers 5, 5', 6, 6', that is to say a further vertical longitudinal central partition 4' can be provided in the vehicle in addition to a horizontal longitudinal partition 4 oriented approximately centrally in the vehicle. The further fraction from the upper chamber b in the container 9 consequently passes into the upper chamber 5', whilst the fraction from that chamber d of the garbage container which is located underneath passes into the stowage space 6' located below the chamber 5'. In this case, the partition 45' constitutes an extension of the partition 4' in the garbage vehicle.

On account of the pivoted-up flap 22*a*, both the upper chamber b and the lower chamber d of the garbage container 9 could be emptied into the lower stowage space 6' of the garbage vehicle. Of course, the loading flap 22*a* can likewise place itself with its front edge 29 onto the front edge 32 of the transverse partition 13, so that that fraction of the garbage container 9 which is arranged in the upper chamber b likewise passes into the upper stowage space 5' of the garbage vehicle.

The introduction of garbage from a plurality of chambers or a specific chamber of the garbage container into a specific stowage space of the garbage vehicle may be expedient if the garbage is contaminated.

Figure 9A:
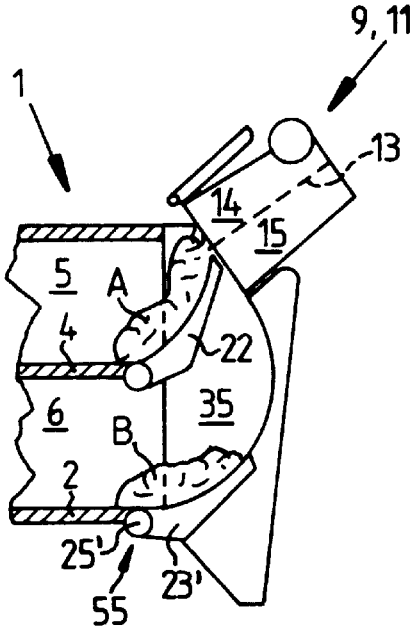
FIGS. 9*a*, 9*b* show an alternative embodiment of an arrangement of the loading troughs on the garbage vehicle.
Figure 9B:
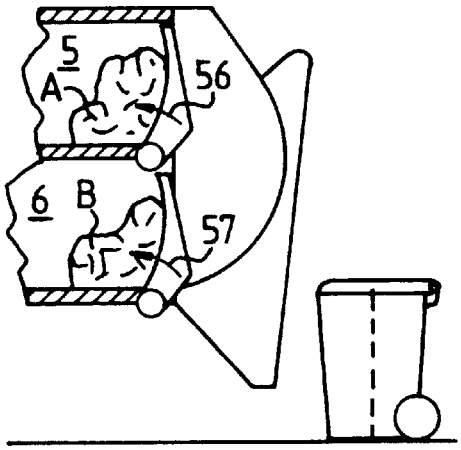

According to the further representation in FIGS. 9*a*, 9*b*, the upper loading trough 23, articulated in the vehicle roof region in the preceding figures, can,if appropriate, also be designed as a lower loading trough 23' which is articulated in the region of the vehicle bottom at a joint 55 having a horizontal axis of rotation. In this case, the loading trough 22 articulated in the region of the horizontal partition 4 once again accomplishes the partitioning off of the passage well or discharge well 35, so that the fraction A can pass out of the corresponding chamber 14 into the upper stowage space 5 of the garbage vehicle. The representation according to FIG. 9*a* therefore corresponds to the representation according to FIG. 3*a*. However, the loading trough 22 according to FIG. 9*a* cannot be cleared by a further loading trough. This is carried out, instead, in that the loading trough 22 itself guides the garbage fraction A into the stowage space 5 as a result of a counterclockwise rotational movement (arrow 56), as shown in FIG. 9*b*.

The loading trough 23', placed at the bottom in FIGS. 9*a*, 9*b*, then clears the fraction B from the discharge well 35 into the lower storage space 6, likewise as a result of a counterclockwise rotational movement (arrow 57).

According to the representation in FIG. 9*b*, the two loading flaps 22, 23' serve once again for closing the stowage spaces 5, 6.

The exemplary embodiment according to FIG. 10 shows, in FIGS. 10*a* to 10*e*, a diagrammatic representation of various types of garbage vehicle, together with a tail part 7 which belongs to them as standard and which is an integral part of the garbage vehicle. In this case, the representation in FIG. 10*a* corresponds to the exemplary embodiment according to FIGS. 1 to 7, that is to say the garbage vehicle 1 contains an upper stowage space 5 for receiving the fraction A, a lower stowage space 6 for receiving the fraction B and the two loading troughs 22, 23 for closing off the stowage spaces 5 and 6. According to FIG. 1*b* described, the arrangement according to FIG. 10*a* could also have, in addition, a vertical longitudinal partition for division into four stowage spaces A–D.

As previously described and as represented in FIGS. 10*b*, 10*e*, the stowage spaces 5, 6 or A–D on the garbage vehicle 1 can also be formed by two or more containers 60, 61 which are placed one above the other and which are each closed by means of a rear loading trough 22, 22' or 23. Each container then has a container bottom 54 not shown in any more detail in FIG. 10*e*, the lower container bottom 54 being placed on the vehicle bottom 2. The version according to FIG. 10*e* can also be designed not as a container type, but in a similar way to FIG. 10*a*.

Both the exemplary embodiment according to FIG. 10*a* and that according to FIG. 10*b* have in each case the tail part 7 shown in FIG. 10*d*, which can be flanged or attached to the rear connection surface 51 and which is an integral part of the vehicle body. Particularly in the container design according to FIGS. 10*b* and 10*e*, the tail part 7 can then be removed or detached from the connection surface 51. In this case, in the exemplary embodiment according to FIGS. 12*a* to 12*d* which is yet to be described, one or more loading troughs 22, 23 having intermediate frames 85, 85' can be provided.

A further design alternative is shown in the representation according to FIG. 10*c*, in which the horizontal and, if appropriate, also the vertical partition 4, 4' of the other exemplary embodiments are dispensed with completely, so that a nonsubdivided stowage space is obtained. In particular, this exemplary embodiment, too, can be designed as the container type with the container 62'. As a result, a garbage vehicle in this case has a single stowage space 59 which serves for receiving the garbage of any composition. However, the arrangement of the two loading troughs 22, 23 is nevertheless carried out in the same way as in the exemplary embodiments according to FIGS. 10*a*, 10*b*, that is to say that garbage introduced into the stowage space 59 is once again, as previously described, received by the loading troughs 22, 23 via the flanged-on charging or dumping device 8 and transported into the stowage space 59. The two loading troughs 22, 23 then serve equally as a tail closure of the container 62 to be extracted from the garbage vehicle. Such an arrangement of the invention serves, in particular, for the handling of single-chamber garbage containers.

As already described with regard to the exemplary embodiment according to FIGS. 10*a* to 10*e*, the garbage vehicle can be equipped with a tail part 7 capable of being handled in a flexible way. According to the representation of the invention in FIGS. 11*a* to 11*c*, the tail part 7 is articulated pivotably on the vehicle bottom 2 via a four-bar chain 65. The four-bar chain 65 consists of a double rocker arrangement with a first rocker lever 66 and with a second rocker lever 67 which are fastened in a bent design to the vehicle bottom via two lower articulation points 63, 64 and to the tail part 7 via the articulation points 63' 64'. In the representation according to FIG. 11*a*, the tail part 7 is in an approximately vertical position, that is to say the tail part 7 is flanged onto the connection surface 51 in FIG. 10.

Figure 11A:
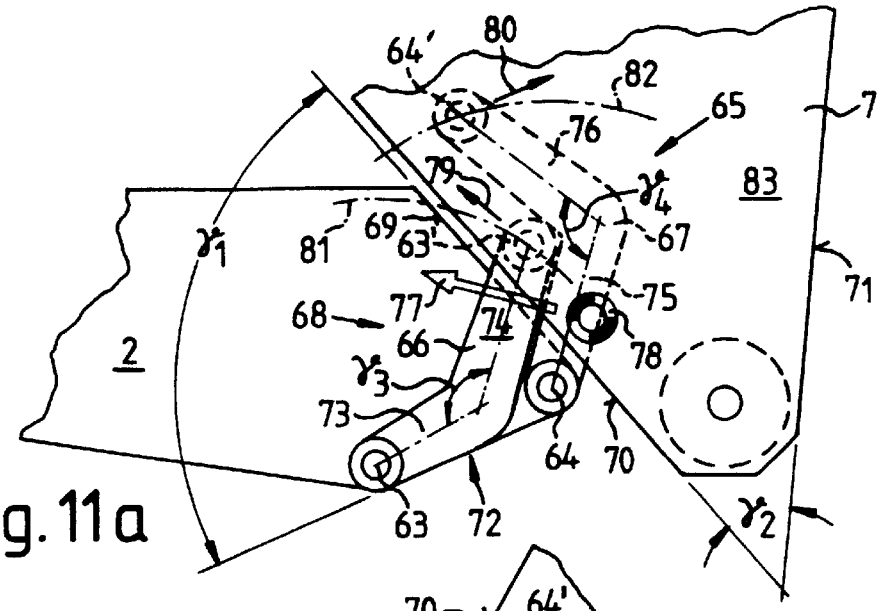
FIGS. 11*a*–11*c* show the mechanical construction of a swing-round tail part.

According to the representation in FIG. 11*a*, the end region 68 of the vehicle bottom 2 is of V-shaped design, with an acute angle $\gamma_1 \approx 75°$. The oblique flank 70 of the tail part 7 runs on the upper flank 69 and forms an angle $\gamma_2 \approx 45°$ with the upward-directed rear wall 71. The two rocker levers 66, 67 are, in this case, arranged in such a way that the lower articulation points 63, 64 come to rest approximately on the lower oblique flank 72 of the V-shaped end region 68. From there, the lower bent leg 73 runs approximately parallel to the lower oblique flank 72 and is at an angle $\gamma_3 \approx 135°$ with the upper leg 74. In the arrangement according to FIG. 11*a*, the lower leg 75 of the further rocker lever 67 is arranged approximately parallel and adjacent to the upper leg 74 of the rocker lever 66, that is to say the bend of the rocker lever 67 is laid approximately around the articulation point 63'. The upper leg 76 of the rocker lever 67 is once again designed so as to be bent at an angle $\gamma_4 \approx \gamma_3 = 135°$.

Figure 11B:
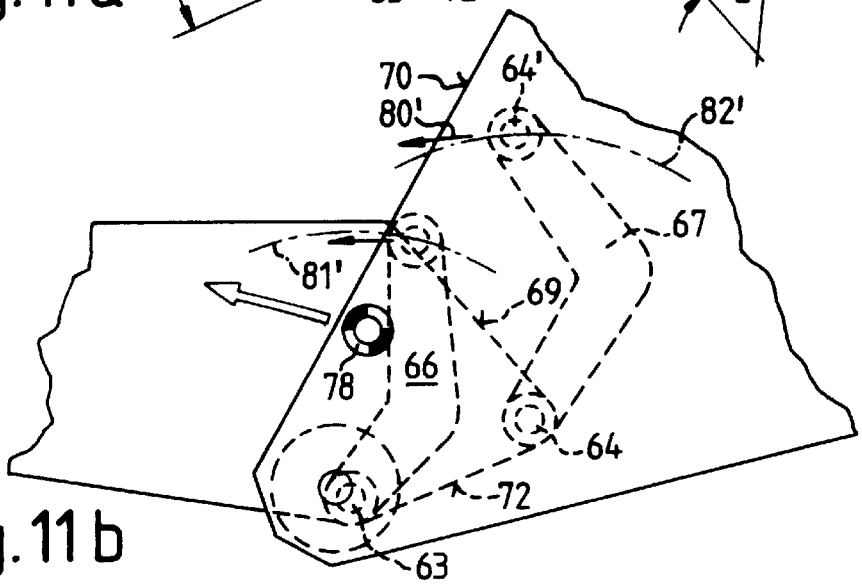
Figure 11C:
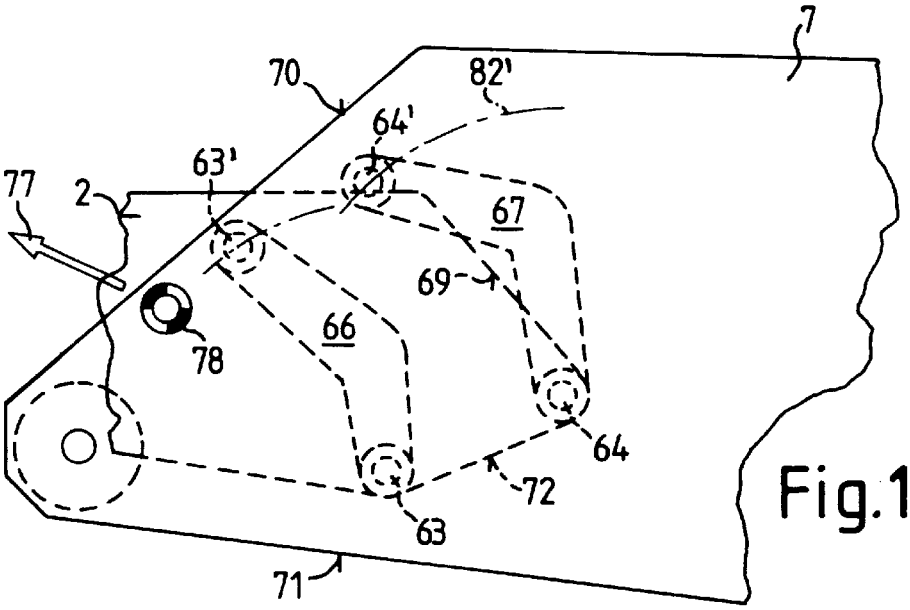

The arrangement according to FIG. 11*a* marks the starting point for a pivoting movement of the tail part 7, in order to come into an approximately horizontal position according to the representation in FIG. 11*c*. As a result, a force 77 is exerted at the articulation point 78 of the tail part 7 and draws this point in the direction of the vehicle bottom 2. The four-bar chain, formed from the two rocker levers 66, 67, then opens. The two articulation points 63, 64 remain rigidly on the stationary vehicle bottom 2, whilst the upper articulation point 63' moves in the direction of the arrow 79, that is to say in the direction of the garbage vehicle, and upper articulation point 64' first moves in the direction of the arrow 80, that is to say rearward. The rocker levers 66, 67, initially located next to one another, thereby open into a position as shown in FIG. 11*b*. The movement of the upper articulation point 63' on the circular arc 81 and the movement of the articulation point 64 on the circular arc 82 are shown in addition.

From the state according to FIG. 11*b*, the direction of movement of the upper articulation point 64' of the rocker lever 67 is reversed, so that the movement arrow 80' points in the direction of the vehicle. This results in a movement of the two rocker levers 66, 67 in the direction of the vehicle bottom 2, the articulation points 63', 64' moving into the position according to FIG. 11*c* on the circular arcs 81', 82' shown.

Since the tail part 7 thus moves in the direction of the vehicle bottom 2, the tail part 7 must have two lateral side cheeks 83 which then slide laterally past the vehicle bottom 2 by means of the four-bar chain. In this position according to FIG. 11*c*, the containers shown in FIGS. 10*b*, 10*c* are placed on supports, so that the vehicle, including the vehicle bottom 2 and the tail part 7, can pass through under the containers.

The two four-bar chains articulated laterally relative to the vehicle are accordingly articulated to right and left on the pivoting frame of a vehicle intermediate frame by means of the articulation points 63, 64, the pivoting-out movement of the tail part being initiated by the force effect at the point 78. In this case, according to the representation in the initial position as shown in FIG. 11*a*, the articulation point 78 is located somewhat obliquely above the articulation point 64 in the lower leg 75 of the rocker lever 67.

The return movement of the tail part 7 out of the position according to FIG. 11*c* takes place by the reversal of the force 77 on the point 78. The vehicle bottom 2 can be designed as a vehicle intermediate frame.

Figure 12A:
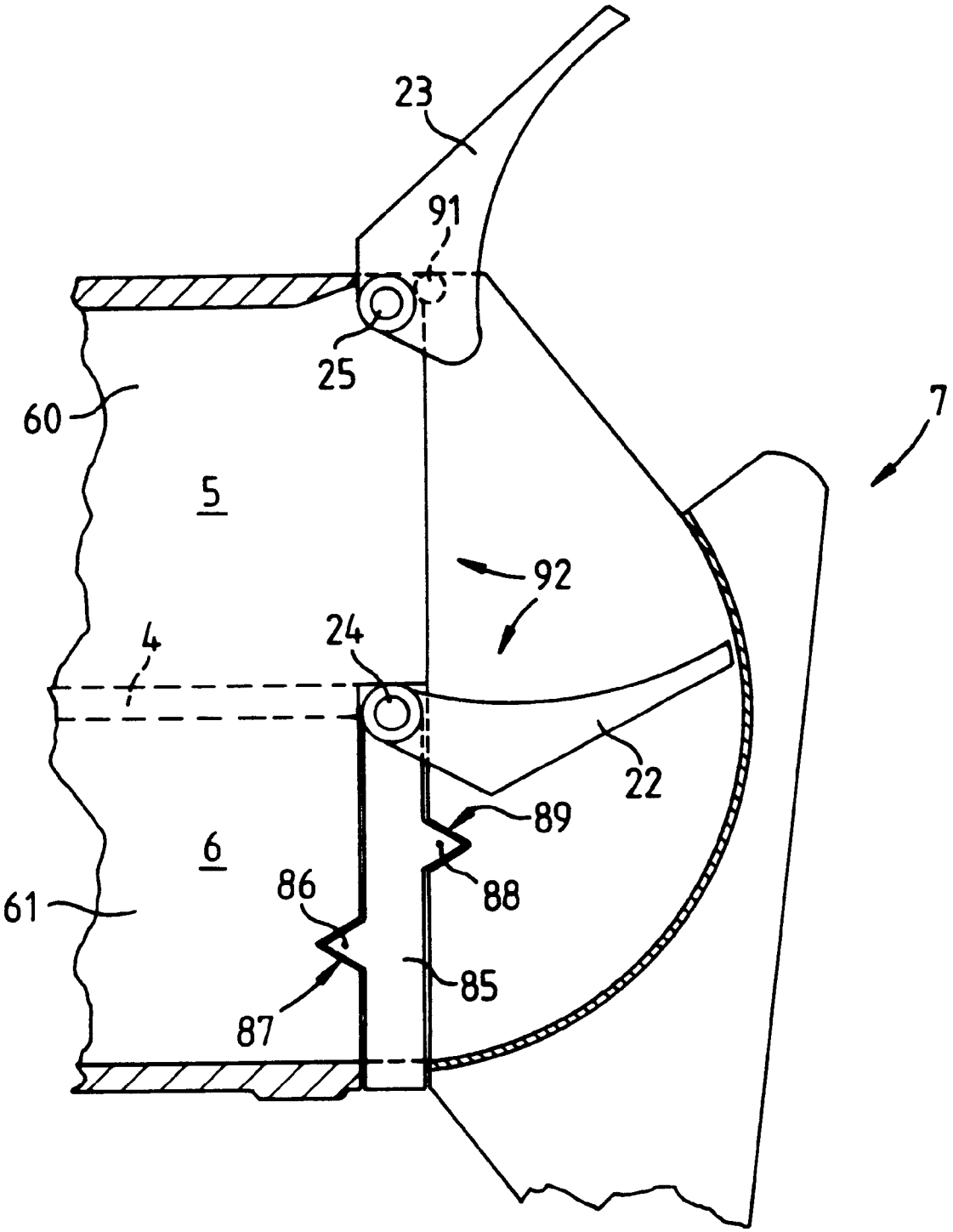
FIGS. 12*a*–12*d* show a reciprocal fastening of the loading flap or loading trough on the container and on the loading space.
Figure 12B:
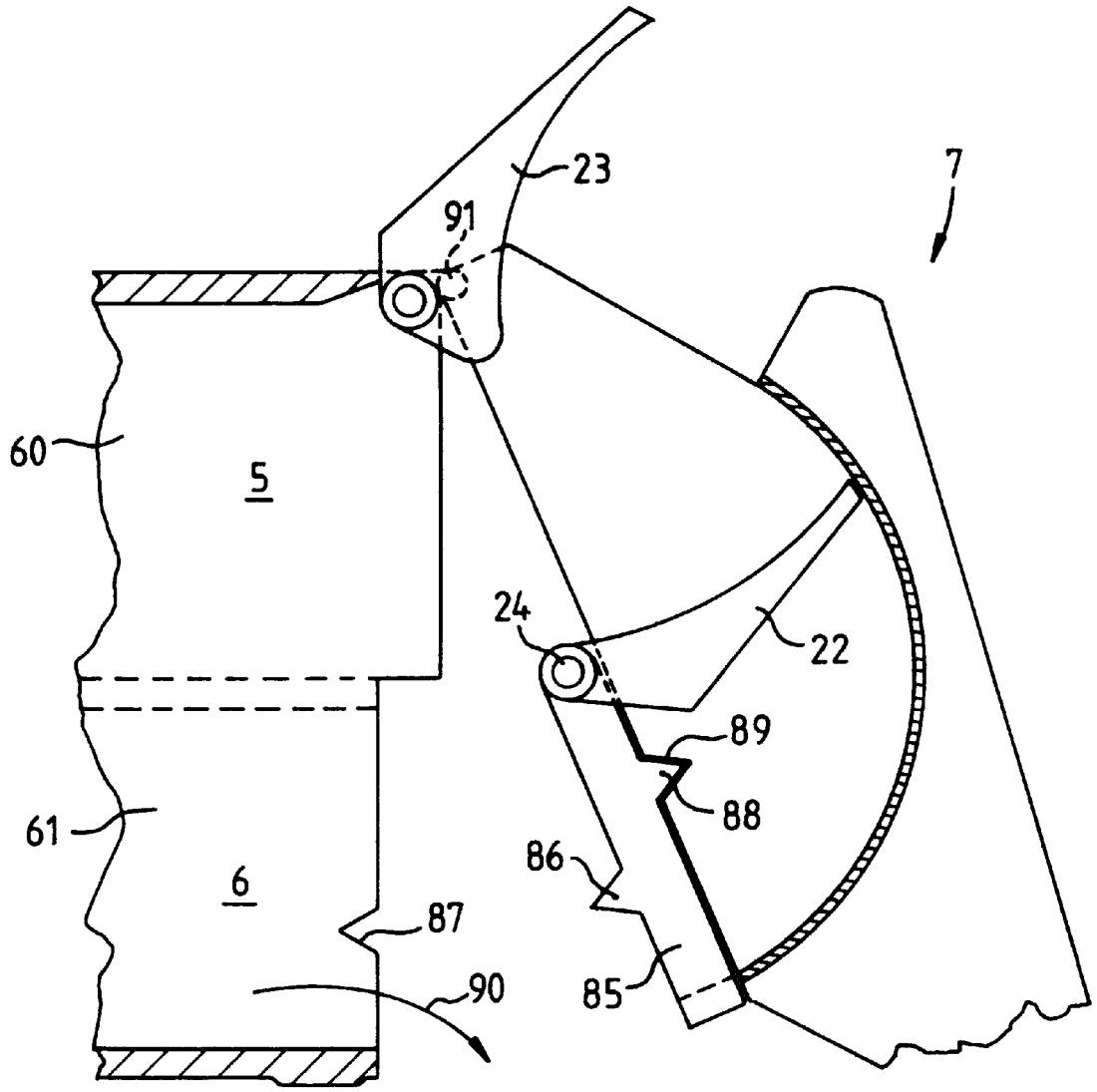

According to the development of the invention as shown in FIGS. 12*a* to 12*d*, the tail part 7 has one or more intermediate frames 85, 85' or "interchangeable frames", on which the loading and tidying devices or loading troughs 22, 23 are mounted in each case. The particular feature is that these intermediate frames 85, 85' can be fastened both to a tail part 7 capable of being pivoted out rearward and to the respective containers 60, 61 having associated stowage spaces 5, 6. In FIG. 12*a*, for example, the loading trough 22 is fastened with its pivot axis 24 to the upper end of the intermediate frame 85, a centering pin 86 on the intermediate frame 85 engaging with an exact fit into an adapted centering guide 87 on the stowage space 6. A further centering pin 88 on the intermediate frame 85 engages into a corresponding centering guide 89 on the rear tail part. The intermediate frame 85 can be connected selectively to the lower stowage space 6 or to the tail part 7, the centerings allowing exact adaptation. FIG. 12*a* shows a tail part 7 which is folded down and is fastened to the stowage spaces 5, 6 and which has an intermediate frame 85 located in between. If, for example, the stowage spaces 5, 6 are to be emptied by pivoting the front part of the stowage spaces upward, then, for example, according to the representation in FIG. 12*b*, the upper stowage space 5 can be closed by means of the loading trough 23, whilst the lower stowage space 6 can be emptied by pivoting upward the tail part, including the intermediate frame 85 flanged on the tail part 7. This is indicated by the arrow 90. In the exemplary embodiment according to FIG. 12*b*, therefore, the tail part 7 is swung up about a pivot axis 91, in order to make it possible to empty one or both stowage spaces 5, 6, and if the intermediate frame 85 were flanged on the lower stowage space 6 of the vehicle said stowage space could either remain closed or likewise be emptied by swinging up the associated loading flap 22. The intermediate frame 85 therefore serves for the selective fastening of the loading trough 22 to the lower stowage space 6 or to the tail part 7.

Figure 12C:
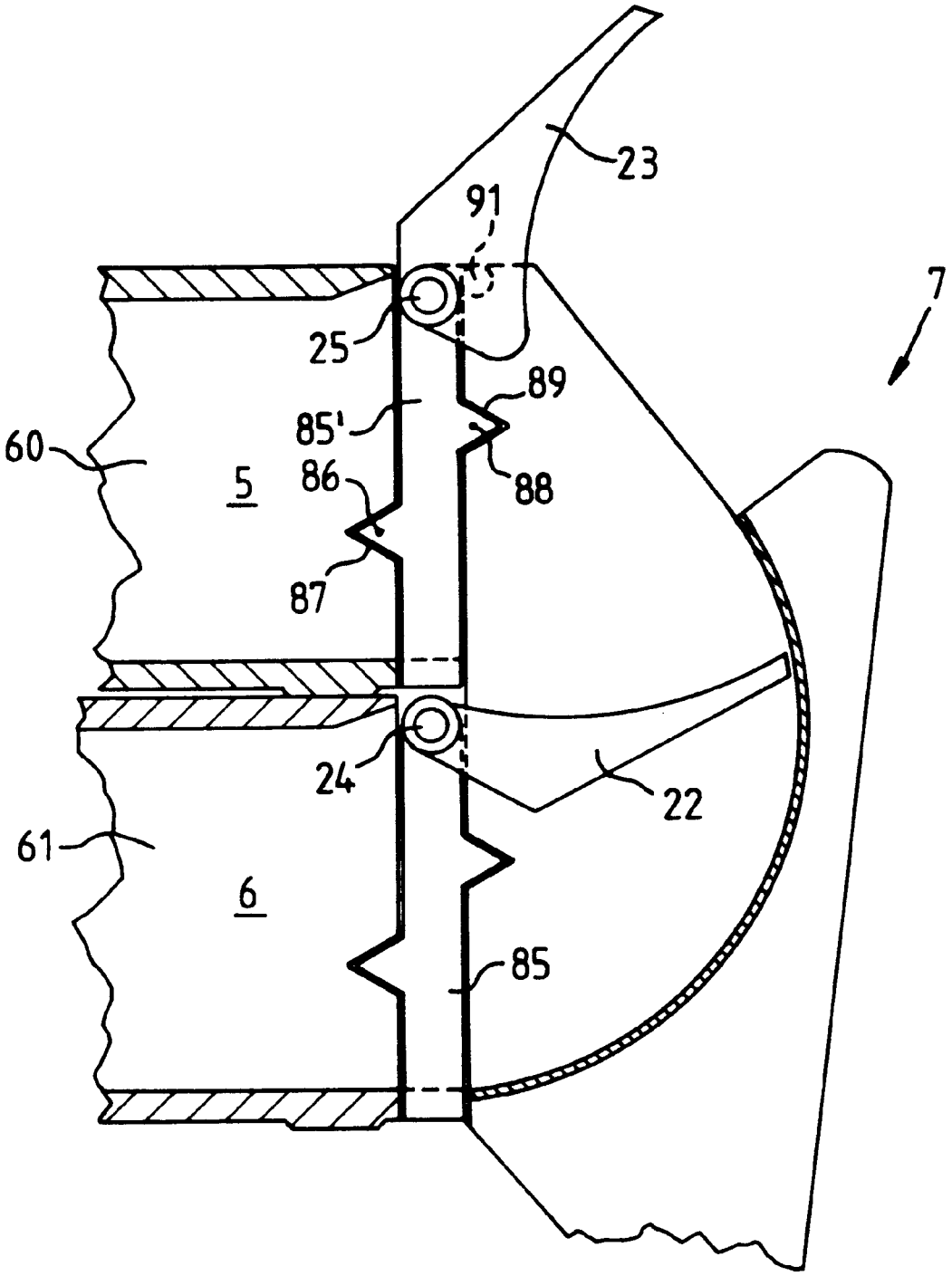
Figure 12D:
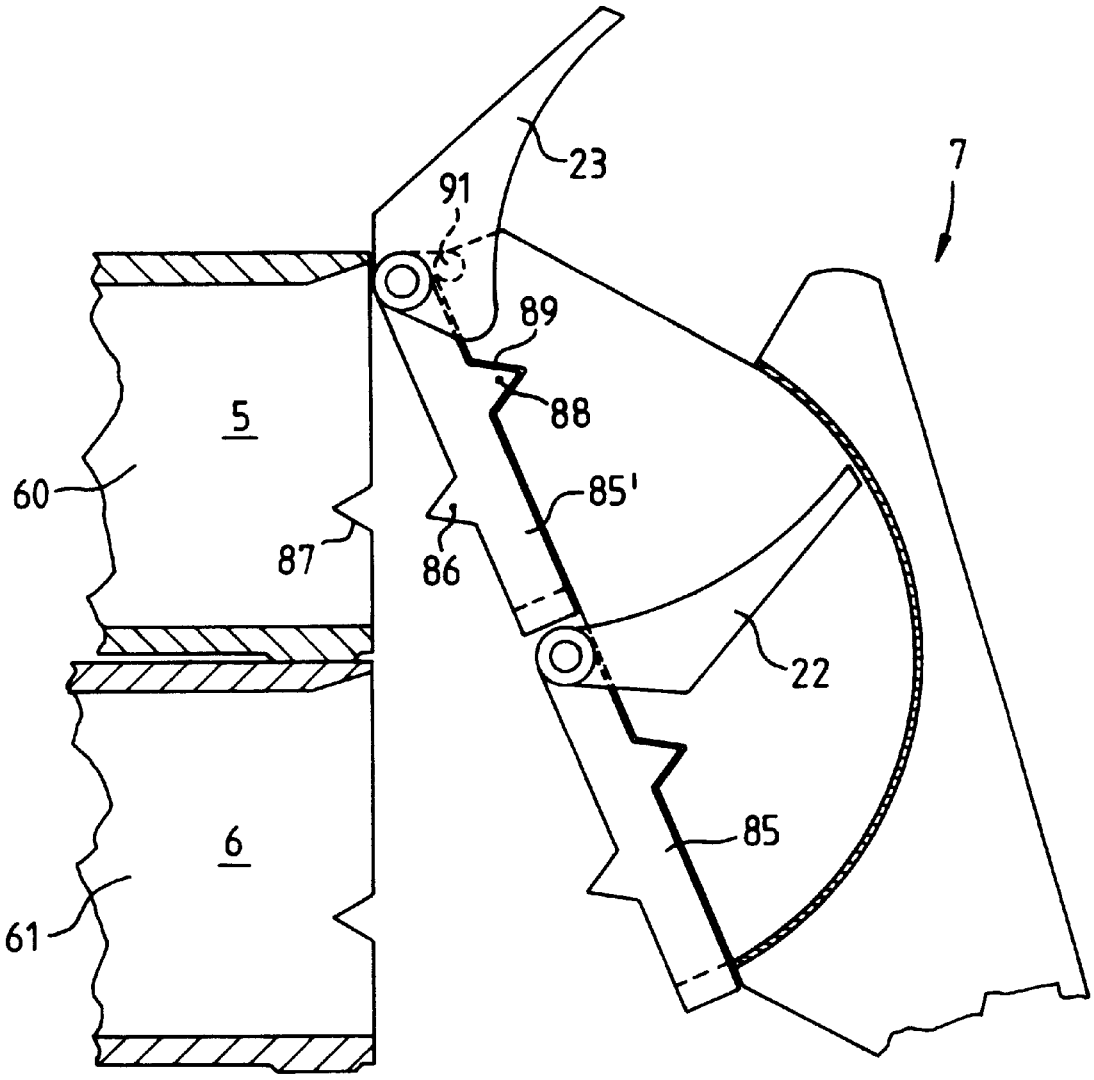

According to the representation in FIGS. 12*c*, 12*d*, the upper stowage space 5 can also be provided with a corresponding intermediate frame 85' which, once again, is to be fastened selectively to the rear tail part 7 or to the stowage space 5. Corresponding centering means 86 to 89 are once again provided. Insofar as the stowage spaces 5, 6 are designed as containers 60, 62 these can be closed or locked selectively by means of the intermediate frames 85, 85' and the loading troughs 22, 23 fastened thereto. However, the loading troughs 22, 23 can also be part of the tail part 7 and, according to the representation in FIG. 12*d*, can be pivoted away from the vehicle via the pivot axis 91. In this case, the tail part 7 forms basically part of the tail region of the vehicle, as described, in principle, with reference to FIG. 11. Of course, the embodiment according to FIGS. 12*a* to 12*d* can also be provided with a single stowage space on the vehicle, in which case, for example in FIG. 12*a* the horizontal partition 4 would be dispensed with. This is therefore represented only by broken lines in FIG. 12*a*. The effect of the possibility of fastening the lower "interchangeable frame 85" having a horizontal pivot axis 24 to the rear tail part 7 of the vehicle proves to be particularly advantageous here, since the entire rear orifice 92 or tail surface 51 of a single stowage space would then be fully exposed and a pivot axis 24 does not obstruct this orifice. This is advantageous particularly in the case of material collected in large pieces.

Of course, it is also possible that the pivot axis 24 can be fastened directly, that is to say without an intermediate frame, selectively to the stowage space 6 or to the tail part 7 or to both. Here, too, it is expedient to position the tidying device 22 on the container by means of centering devices, such as pins 86, 88 and centering guides 87, 89 or, for example, via vertically divided half shells. This applies both to the lower loading trough 22 and to the upper loading trough 23. It may also be noted that, in particular in the case of full garbage vehicles, the loading troughs or tail-flaps 22, 23 can be detained in their position, so that the garbage cannot escape.

The invention is not restricted to the exemplary embodiments represented and described. On the contrary, it also embraces all modifications and developments available to the average person skilled in the art within the scope of the patent claims.

What is claimed is:

1. A garbage collection and transport system for use with a single-chamber or multichamber garbage container for the reception of waste materials of different composition, said garbage collection and transport system comprising:

a garbage vehicle having a stowage space;

a dumping device for handling waste materials from the garbage container located on the garbage vehicle and comprising at least two platform devices for guiding waste materials to said stowage space, said platform devices including a first platform device and a second platform device located one above the other, said second and first platform devices being pivotable about respective vertically-spaced horizontal axes, the horizontal axis of said first platform device being positioned lower than the horizontal axis of the second platform device, wherein, in a first working position, the first platform device receives a fraction of dumped waste material and said second platform device is capable of pushing the fraction of waste material toward the stowage space, and, in a second working position, the first platform device is in a position which allows dumped waste material to bypass the first platform device and then, the first platform device pivots toward the dumped waste material and pushes the dumped waste material to be transported into the stowage space.

2. A garbage collection and transport system according to claim 1, wherein, the horizontal axis of the first platform device is arranged approximately at half the stowage space height.

3. The system as claimed in claim 1, wherein said at least two platform devices respectively include two lower and two upper loading troughs which are arranged next to one another and which extend approximately over half the vehicle width or over the width of an outlet orifice of the garbage container capable of being applied to the dumping device.

4. The system as claimed in claim 1, wherein the garbage vehicle has two stowage spaces which are formed by at least two individual containers arranged one above the other, the platform devices being fixedly connected to or capable of being flanged about their horizontal pivot axes or the respective containers and forming a rear closure wall.

5. The system as claimed in claim 1, wherein the garbage vehicle comprises a nonsubdivided stowage space which can be supplied with garbage and closed by said at least two platform devices of approximately equal size which are located one above the other.

6. The system as claimed in claim 1, wherein two second platform devices are arranged next to one another and extend approximately over half the vehicle width or over the width of an outlet orifice of the garbage container capable of being applied to the dumping device.

7. The system as claimed in claim 1, wherein two first platform devices are arranged next to one another and extend approximately over half the vehicle width or over the width of an outlet orifice of the garbage container capable of being applied to the dumping device.

8. The system as claimed in claim 1, wherein the garbage container has at least one transverse partition and at least one longitudinal partition forming a number of chambers in the garbage container, and wherein the garbage vehicle is provided with partitions so that a number of stowages spaces corresponding to the number of chambers in the garbage container are formed in the garbage vehicle.

9. The system as claimed in claim 1, wherein the dumping device has at least one upper charging orifice which serves for receiving a garbage container, the first platform device forming an extended partition for feeding the different compositions of waste materials contained in the garbage container to an associated stowage space in the garbage vehicle.

10. The system as claimed in claim 9, wherein the garbage vehicle has a loading tail, said loading tail having a cylindrical wall section, and wherein said first platform device has an end connected to the garbage vehicle to pivot about the horizontal axis and a pivotable free end, and the outer surface of the cylindrical wall section forms a lateral limitation during the pivoting movement of at least one of said first and second platform devices, the wall section being in the form of a circular segment in longitudinal cross section and forming a lateral limiting wall for a passage well which has an upper transverse closure edge that terminates adjacent the at least one upper charging orifice, and forming the end limitation of the pivotable free end of the first platform device.

11. The system as claimed in claim 1, wherein said garbage vehicle has a loading tail and the stowage space has a container for receiving the waste material, the loading tail being fastened to the garbage vehicle by means of two four-bar chains arranged laterally on a pivoting frame or a vehicle bottom, said loading tail being pivoted rearwardly in such a way that the loading tail can pass under the container which is jacked up on supports on the vehicle.

12. The system as claimed in claim 11, wherein the loading tail is fastened to the vehicle intermediate frame or to the vehicle bottom via one of the two four-bar chains with a double rocker arrangement which comprises, in each case, two bent rocker levers arranged laterally on the garbage vehicle, the rocker levers being capable of being moved in the manner of a parallelogram guide.

13. The system as claimed in claim 1, wherein said garbage vehicle has a loading tail, said dumping device being located on the loading tail, and said stowage space has an upper roof wall and said second platform device is located on a tail-side of the upper roof wall, the second platform device and the first platform device closing with a circular pivoting movement the stowage space of the garbage vehicle.

14. The system according to claim 13, wherein the first platform device has a loading surface with a curved cross section which, in a corresponding positioning of the first platform device, is arranged approximately on a circumscribed circle of an outer edge of the second platform device.

15. The system as claimed in claim 14, wherein the second platform device, in a circular pivoting movement, cleans the waste material resting on the first platform device into the stowage space of the garbage vehicle which is located behind the second platform device in a clearing-off operation.

16. The system as claimed in claim 15, wherein the dumping device has vertical intermediate walls, and the second platform device has longitudinal slots into which the intermediate walls can be introduced.

17. The system as claimed in claim 1, wherein said garbage vehicle has a separable loading tail and the garbage vehicle is divided into a plurality of stowage spaces which are capable of being separated from the loading tail, the separable, loading tail forming the dumping device and including the platform devices.

18. The system as claimed in claim 17, further comprising a drive for the platform devices which is fastened to one of the stowage spaces or the loading tail.

19. The system as claimed in claim 17, wherein said loading tail has an intermediate frame and said loading tail is movable, at least one platform device being fastened to the intermediate frame which is connected by either a flange or a detent to one of the stowage space and the movable loading tail.

20. The system as claimed in claim 1, wherein the stowage space is divided into upper and lower stowage spaces and said first platform device has an end connected to the horizontal axis and a free end, the free end of said first platform device is pivotable and alignable with a chamber of a garbage container to be emptied, said first platform device forming a variably positionable partition between the upper and the lower stowage space of the garbage vehicle.

21. The system as claimed in claim 20, for use with a multichamber garbage container, wherein said garbage vehicle has a loading tail, said dumping device being located on the loading tail, and said first platform device has its free pivotable end in alignment with a central partition of the multichamber garbage container, said central partition being directed transversely relative to the loading tail of the vehicle.

22. The system as claimed in claim 20, wherein the multichamber garbage container has a plurality of chambers with respective discharge edges, and the free end of the pivotable first platform device can be positioned adjacent the discharge edge of a chamber of the garbage container for the purpose of intercepting a corresponding one of the different compositions of waste materials.

23. The system as claimed in claim 20, wherein said garbage vehicle has a loading tail, said dumping device being located on the loading tail, said upper stowage space has an upper roof wall and said second platform device is located on the tail-side of the upper roof wall, the second platform device and the first platform device respectively closing with a circular pivoting movement the upper stowage space and the lower stowage space of the garbage vehicle.

24. The garbage collection and transport system as claimed in claim 1, further comprising a horizontal partition dividing said stowage space into upper and lower stowage spaces and said first platform device has an end pivotably connected to a portion of the partition and a free end, wherein the horizontal axis of said first platform device is arranged in said portion of the partition and said first platform device is pivotable about the horizontal axis so that it forms a variably positionable extension of said partition, the free end of said first platform device being positioned relative to the garbage container in such a way that the different composition waste materials can be fed to the respective upper and lower storage spaces.

25. The system as claimed in claim 24, wherein the first platform device is articulated adjacent the horizontal partition of the garbage vehicle and is divided into a plurality of loading trough segments actuatable independently of one another, the width of the loading trough segments corresponding approximately to the width of a chamber to be emptied of a garbage container.

26. The system as claimed in claim 25, wherein the dumping device has vertical intermediate walls which are arranged between the loading trough segments, the loading trough segments being movable between these intermediate walls.

27. The system as claimed in claim 25, wherein the loading trough segments have lateral wall sections for forming an intercepting pan.

28. A garbage collection and transport system for use with a single-chamber or multichamber garbage container for the reception of waste materials of different composition, said garbage collection and transport system comprising:

a garbage vehicle having a plurality of superposed stowage spaces with a partition separating respective stowage spaces; and a dumping device for handling waste materials from the garbage container located on the garbage vehicle and comprising a plurality of platform devices for guiding waste materials to said plurality of stowage space, each platform device located one above the other and being pivotable about respective vertically-spaced horizontal axes, the number of platform devices corresponding to the number of superposed stowage spaces, each platform device corresponding to a respective stowage space and being capable of pushing waste material to be transported into the respective stowage space.

29. A garbage collection and transport system for use with a single-chamber or multichamber garbage container for the reception of waste materials of different composition, said garbage collection and transport system comprising:

a garbage vehicle having a stowage space;

a dumping device for handling waste materials from the garbage container located on the garbage vehicle and comprising at least two platform devices for guiding waste materials to said stowage space, said platform devices including a first platform device and a second platform device located one above the other, said second and first platform devices being pivotable about respective vertically-spaced horizontal axes and being positioned such that said first platform device is positioned lower than the second platform device, wherein, in a first working position, the second platform device receives a fraction of the waste material and is capable of pushing the waste material toward the stowage space, and in a second working position, the second platform device is arranged in a position which allows dumped waste material to bypass the second platform device and to be received by the first platform device which then pivots and pushes the dumped waste material to be transported to the stowage space.

30. The system as claimed in claim 29, wherein said garbage vehicle has a loading tail and said stowage chamber has an upper stowage space and a lower stowage space, said dumping device being located on the loading tail, said lower stowage space having a bottom portion, and the first platform device is located on the tail-side of the bottom portion of the lower stowage space, the second platform device and the first platform device respectively closing with a circular pivoting movement the lower stowage space and the upper stowage space of the garbage vehicle.

* * * * *